US008407851B2

(12) United States Patent
Moyher, Jr. et al.

(10) Patent No.: US 8,407,851 B2
(45) Date of Patent: Apr. 2, 2013

(54) VACUUM CLEANER WITH HAIR COLLECTION ELEMENT

(75) Inventors: George Moyher, Jr., Cedar Springs, MI (US); Steve Butkiewicz, Wyoming, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 13/354,583

(22) Filed: Jan. 20, 2012

(65) Prior Publication Data

US 2012/0110778 A1 May 10, 2012

Related U.S. Application Data

(63) Continuation of application No. 11/683,744, filed on Mar. 8, 2007, now Pat. No. 8,117,714, which is a continuation-in-part of application No. 11/371,721, filed on Mar. 9, 2006, now Pat. No. 7,305,731.

(60) Provisional application No. 60/659,786, filed on Mar. 9, 2005.

(51) Int. Cl.

| | |
|---|---|
| ***A47L 5/00*** | (2006.01) |
| ***A47L 9/04*** | (2006.01) |
| ***A47L 9/06*** | (2006.01) |
| ***A47L 5/10*** | (2006.01) |
| ***A47L 5/26*** | (2006.01) |
| ***A47L 25/00*** | (2006.01) |

(52) U.S. Cl. ..... 15/364; 15/393; 15/383; 15/104.002

(58) Field of Classification Search ..... 15/364, 15/104.002, 393, 369, 368

See application file for complete search history.

(56) References Cited

U.S. PATENT DOCUMENTS

| | | | | |
|---|---|---|---|---|
| 1,348,587 | A | 8/1920 | Rosenfield | |
| 1,907,370 | A | 5/1933 | Schoeller | |
| 2,482,166 | A * | 9/1949 | Gage | 55/297 |
| 3,795,938 | A | 3/1974 | Caporaso | |
| 3,955,238 | A | 5/1976 | Remijas | |
| 4,091,496 | A | 5/1978 | Desrosiers et al. | |
| 4,143,441 | A | 3/1979 | Brooks et al. | |
| 4,173,807 | A | 11/1979 | Maier | |
| 4,319,379 | A | 3/1982 | Carrigan et al. | |
| 4,912,805 | A | 4/1990 | Krasznai et al. | |
| 5,502,873 | A | 4/1996 | Hogan | |
| 5,555,599 | A | 9/1996 | Markley | |
| 5,930,862 | A | 8/1999 | Garrett | |
| 6,421,874 | B1 * | 7/2002 | McCormick | 15/364 |
| 7,159,274 | B2 | 1/2007 | Freidell | |
| 2001/0042282 | A1 | 11/2001 | Sjogreen | |
| 2002/0032949 | A1 | 3/2002 | Putics et al. | |
| 2002/0166512 | A1 | 11/2002 | Corbett | |
| 2005/0044659 | A1 | 3/2005 | Rickman | |
| 2005/0262659 | A1 | 12/2005 | Roschi et al. | |
| 2005/0273971 | A1 * | 12/2005 | Cho et al. | 15/377 |
| 2006/0075596 | A1 * | 4/2006 | Bosses | 15/320 |
| 2006/0118137 | A1 | 6/2006 | Freidell | |
| 2006/0200926 | A1 | 9/2006 | Graham | |
| 2008/0086838 | A1 | 4/2008 | Yoo et al. | |

FOREIGN PATENT DOCUMENTS

| | | | |
|---|---|---|---|
| DE | 19630772 | A1 | 2/1998 |
| EP | 1911387 | A1 | 4/2008 |
| FR | 2547190 | A1 | 12/1984 |
| GB | 2140673 | A | 12/1984 |
| JP | 02049620 | | 2/1990 |
| JP | 3292919 | A | 12/1994 |

(Continued)

*Primary Examiner* — Bryan R Muller
(74) *Attorney, Agent, or Firm* — McGarry Bair PC

(57) ABSTRACT

A vacuum cleaner comprises a hair collection assembly having a hair collection element adapted to collection hair from a surface to be cleaned. The hair collection element is configured to collect hair on the surface to be cleaned substantially only when the cleaning head is moved in a first direction and substantially not when the cleaning head is moved in a second direction.

14 Claims, 31 Drawing Sheets

FOREIGN PATENT DOCUMENTS

| | | | |
|---|---|---|---|
| JP | 08019493 | A | 8/1996 |
| JP | 3034892 | | 3/1997 |
| JP | 2000157461 | | 6/2000 |
| JP | 3109573 | | 5/2005 |
| JP | 20063440848 | A | 12/2006 |
| WO | 9210967 | | 7/1992 |
| WO | 9210967 | A1 | 7/1992 |
| WO | 02091818 | A2 | 11/2002 |

* cited by examiner

VACUUM CLEANER WITH HAIR COLLECTION ELEMENT

CROSS-REFERENCE TO RELATED APPLICATIONS

This application is a continuation of U.S. patent application Ser. No. 11/683,744, filed on Mar. 8, 2007, now U.S. Pat. No. 8,117,714, issued Feb. 21, 2012, which is a continuation-in-part of U.S. patent application Ser. No. 11/371,721, filed on Mar. 9, 2006, now U.S. Pat. No. 7,305,731, issued, Dec. 11, 2007, which claims priority to U.S. Provisional Patent Application No. 60/659,786, filed on Mar. 9, 2005, all of which are incorporated herein by reference in their entirety.

BACKGROUND OF THE INVENTION

1. Field of the Invention

The invention relates generally to a mechanism used to remove hair and other small debris from fabric surfaces. In one aspect, the invention relates to a hair collection element on a vacuum cleaner.

2. Description of the Related Art

Pet hair from shedding animals, such as dogs and cats, can easily get trapped in fabrics, such as carpets, rugs, upholstered furniture and other similar items. While a vacuum cleaner can suction up some of the hair, a good portion of the hair can become trapped within the fibers of the fabric such that the vacuum cleaner alone cannot suction up the hair. Vacuum cleaners also have similar problems suctioning up other small debris.

Heretofore, carpet rakes, such as the device disclosed in U.S. Pat. No. 5,930,862 to Garrett, have been used to rake carpets by pulling the rake over the surface of the carpet to collect the hair on the carpet and gather it into a pile. Typically, these carpet rakes include a plurality of bristles to rake the hair on the carpet towards the user of the rake, wherein the user then has to pick up the pile of collected hair. However, a more effective hair removal apparatus is desired.

U.S. Pat. No. 1,907,370 to Schoeller discloses a hair and thread gathering nozzle attachment for a vacuum cleaner. The nozzle comprises a wood or metal slider with longitudinal air passages that lead to a suction aperture. The nozzle attachment further comprises strips of non-felting material, such as crepe rubber, that loosen hairs and threads during movement of the nozzle attachment. The hairs and threads are removed through the suction apertures.

SUMMARY OF THE INVENTION

According to the invention, a vacuum cleaner comprises a cleaning head having a suction nozzle adapted to be moved along a surface to be cleaned, and a hair collection assembly provided on the cleaned head and adapted to collect hair from the surface to be cleaned, and comprising an elongated, cylindrical hair collection element, wherein the hair collection element is configured to collect hair on the surface to be cleaned substantially only when the cleaning head is moved in a first direction and substantially not when the cleaning head is moved in a second direction.

DESCRIPTION OF THE PREFERRED EMBODIMENT

Figure 1:
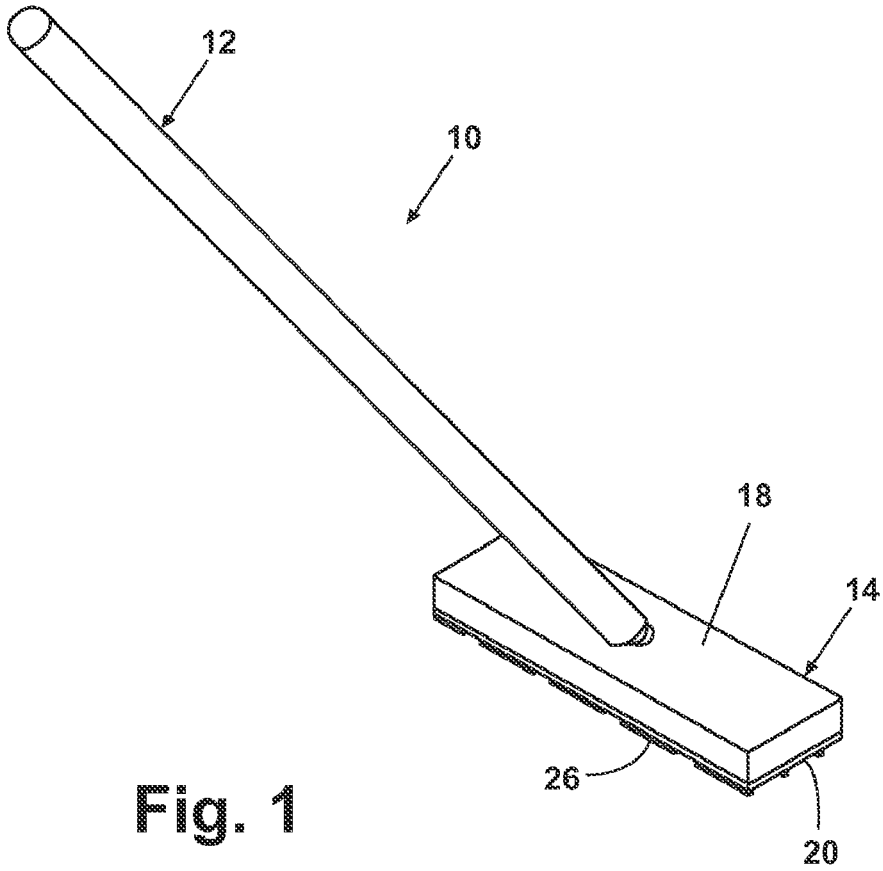
FIG. 1 is a perspective view of a carpet brush in accordance with a first embodiment of the invention.

For purposes of description related to FIGS. 1-7, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, the reference number 10 generally designates a carpet brush comprising a hair collection element. In the illustrated example, the carpet brush 10 includes a handle 12 and a brush head 14 attached at one end of the handle 12. During use, the carpet brush 10 is employed by moving the brush head 14 over a fabric-covered surface, such as a carpet, rug, upholstered furniture or other similar items, having pet hair or other small debris therein to bring the hair and debris to the surface of the fabric-covered surface to easily remove the hair and debris by hand or by using a vacuum cleaner or similar household equipment.

Figure 2:
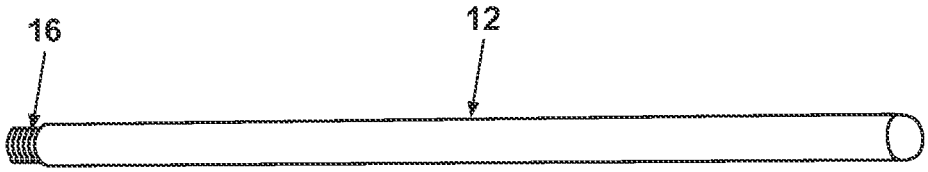
FIG. 2 is a perspective view of a handle of the carpet brush in accordance with the invention.

Referring additionally to FIG. 2, in the illustrated embodiment, the handle 12 is elongated such that a user of the carpet brush 10 can easily use the carpet brush 10 while standing. The illustrated handle 12 is circular and is approximately 4 feet long. However, it is contemplated that the handle 12 could be any length and could have any cross-sectional shape. The handle 12 is preferably made of plastic, although it is contemplated that the handle 12 could be made of any material. Furthermore, it is contemplated that the handle 12 could be extendible. For example, the handle 12 could include a plurality of handle sections configured to be connected together to form a handle 12 of any desired length. Furthermore, the handle 12 could include a pair of telescoping tubes that can be rotated relative to each other as is well known to those skilled in the art to fix the handle 12 in a desired length or one of the tubes could have a plurality of openings configured to accept a spring loaded tab from the other of the tubes to fix the tubes in a desired extended position. In the illustrated embodiment, the handle 12 includes a threaded end 16 configured to be screwed into the brush head 14.

Figure 3:
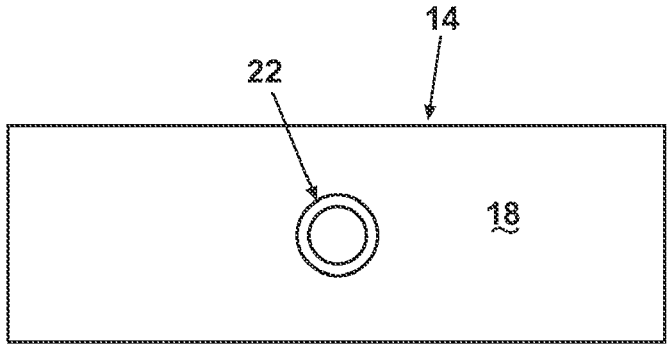
FIG. 3 is a top view of a brush head of the carpet brush in accordance with the present invention.
Figure 4:
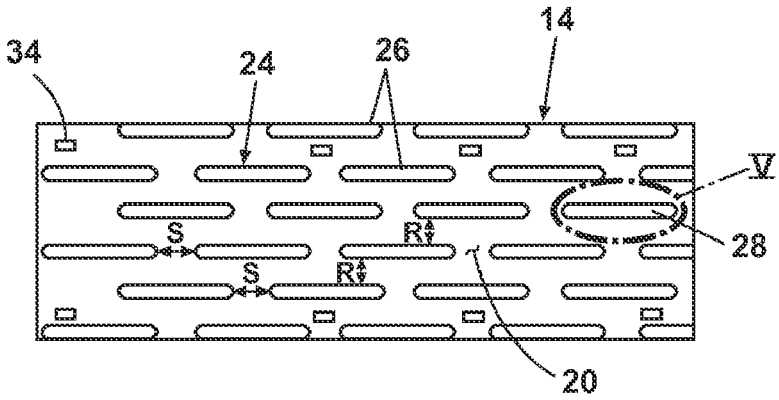
FIG. 4 is a bottom view of the brush head of the carpet brush in accordance with the present invention.

Referring to FIGS. 3 and 4, the illustrated brush head 14 is connected to the handle 12 and has a bottom configured to be brushed against the carpet, etc. to bring the hair and small debris to the surface of the carpet, etc. The brush head 14 includes a top portion 18 and a bottom portion 20. The top portion 18 of the brush head 14 includes an internal threaded opening 22 for accepting the threaded end 16 of the handle 12 therein for connecting the handle 12 to the brush head 14. However, it is contemplated that the handle 12 could be connected to the brush head 14 in any manner. For example, it is contemplated that the handle 12 and the top portion 18 of the brush head 14 could be molded as one integral piece. The top portion 18 of the brush head 14 is preferably made of plastic or wood and includes a rectangular shape, although it is contemplated that the top portion 18 of the brush head 14 could be made of any material and have any shape.

Figure 5:
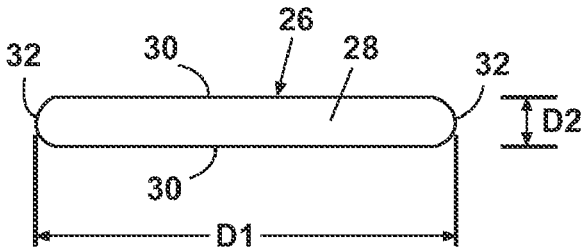
FIG. 5 is a close-up view of section V of FIG. 4.
Figure 6:
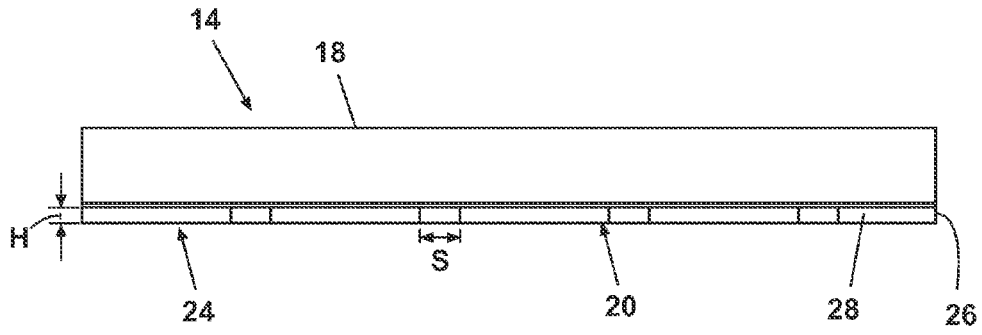
FIG. 6 is a front side view of the brush head of the carpet brush in accordance with the present invention.

Referring to FIGS. 4-6, the bottom portion 20 of the brush head 14 comprises a hair collection element. In the illustrated example, the bottom portion 20 of the brush head 14 is connected to the top portion 18 of the brush head 14 and includes the plurality of projections 24 extending in a direction opposite the handle 12. The projections 24 are elongated and comprise a plurality of rows of ridges 26 having a non-circular face 28 extending opposite to the top portion 18 of the brush head 14. As illustrated, the face 28 is oval, comprising spaced elongated sides 30 joined by arcuate ends 32. Preferably, the projections 24 are formed of an elastomeric material. In the illustrated example, the projections 24 are rubber.

Each projection 24 is elongated, preferably such that the distance $D_1$ between the arcuate ends 32 of the face 28 is greater than the distance $D_2$ between the sides 30. Furthermore the projections 24 are relatively short and can extend from the bottom portion 20 of the brush head 14 a distance H less than a largest dimension of the non-circular face 28 of the ridges 26, which, as discussed above, is preferably the distance $D_1$ between the arcuate ends 32.

In the illustrated example, the projections 24 in each row are aligned and are axially spaced from each other. Preferably, adjacent rows of projections 24 are offset from each other, whereby axial spaces S between adjacent projections 24 in one row are juxtaposed to projections 24 in an adjacent row. In other words, the axial spaces S between adjacent rows are offset from one another. Furthermore, the rows are preferably equally spaced from one another at regular intervals R.

By way of example, and without limitation, the carpet brush 10 according to the present invention can have one or more of the following dimensions: a distance $D_1$ of 0.25 inches; a distance $D_2$ of 1.5 inches; an axial space S of 0.375 inches; a row spacing R of 0.25 inches; and a height H of 0.1875 inches.

In the illustrated embodiment, the entire bottom portion 20 of the brush head 14 is rubber is and attached to the top portion 18 of the brush head 14 using suitable fasteners, such as staples 34. However, it is contemplated that the bottom portion 20 of the brush head 14 could be connected to the top portion 18 of the brush head 14 in any manner. Furthermore, it is contemplated that the top portion 18 and the bottom portion 20 of the brush head 14 could be integral.

The illustrated carpet brush 10 is used by grasping the handle 12 and pressing the projections 24 of the brush head 14 against a fabric surface. The handle 12 is then moved towards or away from the user of the carpet brush 10 while continuing to press the projections 24 against the fabric surface. Preferably, the brush head 14 is moved in a direction perpendicular to the elongated sides 30 of the faces 28 of the ridges 26. As the projections 24 are moved over the fabric surface, the projections 24 will force the hair and/or other small debris towards the top of the fabric surface. At the end of a brush stroke, the hair and/or other small debris is collected in a pile, which can then be easily picked up by hand or using a vacuum cleaner. It is believed that at least one of the shape of the projections 24, the material of the projections 24 and/or the distance that the projections 24 extend from the rest of the bottom portion 20 of the brush head 14 help to make the carpet brush 10 very effective in forcing the hair and/or other small debris towards the top of the fabric surface.

Figure 7:
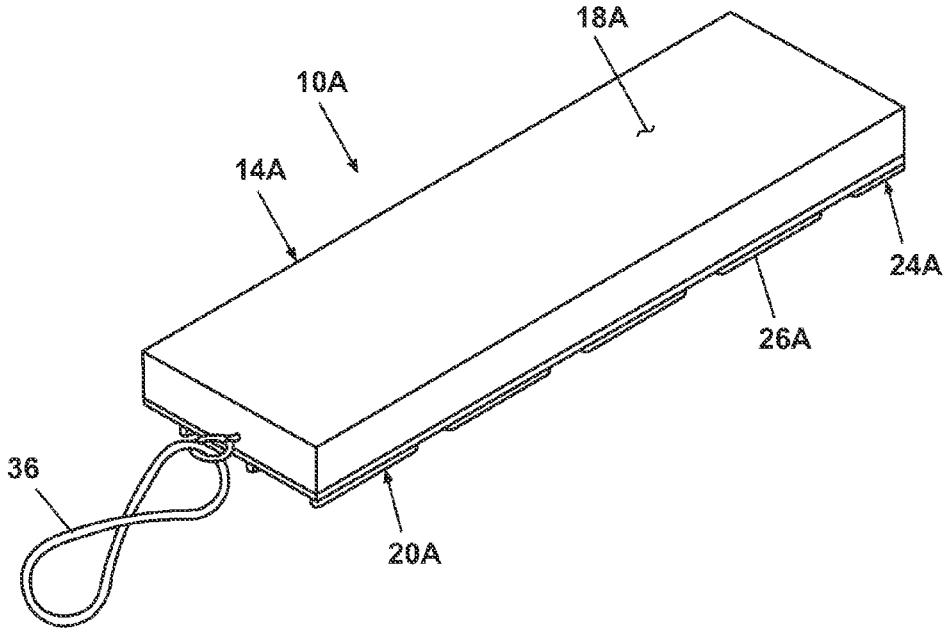
FIG. 7 is a perspective view of a brush head of a carpet brush in accordance with a second embodiment of the present invention.

Referring to FIG. 7, the reference numeral 10*a* generally designates another embodiment of the present invention, having a second embodiment for the carpet brush. Since carpet brush 10A is similar to the previously described carpet brush 10, similar parts appearing in FIGS. 1-6 and FIG. 7, respectively, are represented by the same, corresponding reference number, except for the suffix "A" in the numerals of the latter. The carpet brush 10A is substantially identical to the first embodiment of the carpet brush 10, except that the second embodiment of the carpet brush 10A does not include a handle. Therefore, the carpet brush 10A includes a brush head 14A that has a bottom configured to be brushed against the fabric surface to bring the hair and small debris to the surface of the fabric surface. The brush head 14A includes a top portion 18A and a bottom portion 20A that includes a plurality of projections 24A. The carpet brush 10A can also include a rope or other strap device 36 for easily holding and transporting the carpet brush 10A.

The illustrated carpet brush 10A is used by grasping the top portion 18A pressing the projections 24A of the brush head 14A against the carpet, etc. The top portion 18A is then moved towards or away from the user of the carpet brush 10A while continuing to press the projections 24A against the fabric surface. As the projections 24A are moved over the fabric surface, the projections 24A will force the hair and/or other small debris towards the top of the fabric surface. At the end of a brush stroke, the hair and/or other small debris is collected in a pile, which can be easily picked up by hand or using a vacuum cleaner. Several brush strokes can be made to effectively collect hair and/or other small debris from the carpet.

Figure 8:
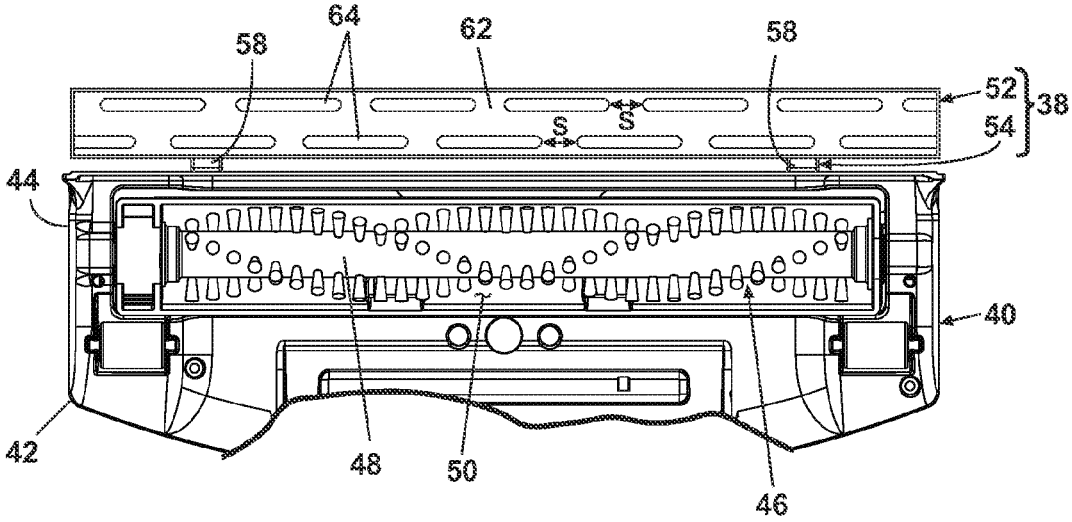
FIG. 8 is a bottom view of a vacuum cleaner base assembly comprising a movable hair collection assembly in accordance with a third embodiment of the invention.
Figure 9:
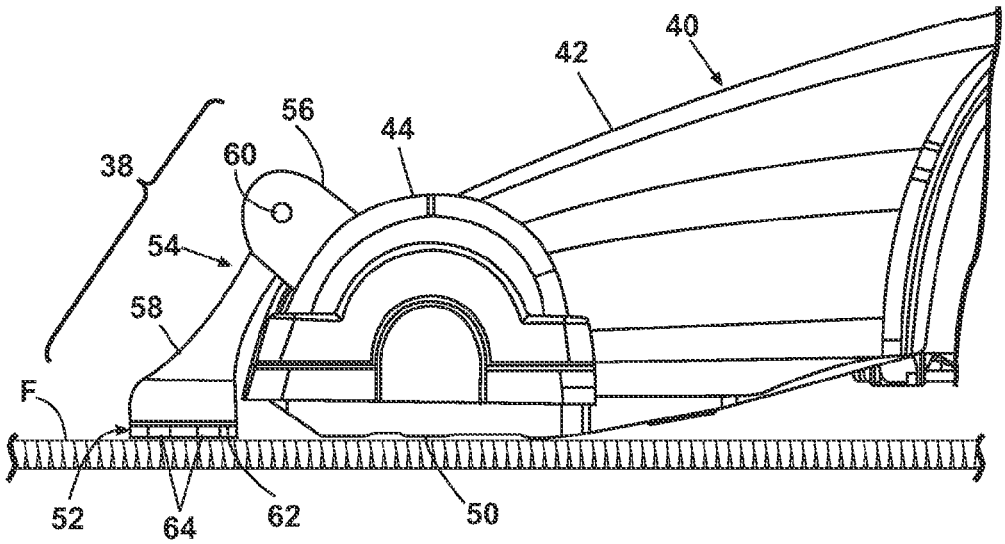
FIG. 9 is a side view of the vacuum cleaner base assembly from FIG. 8, where the hair collection assembly is in a use-position.
Figure 10:
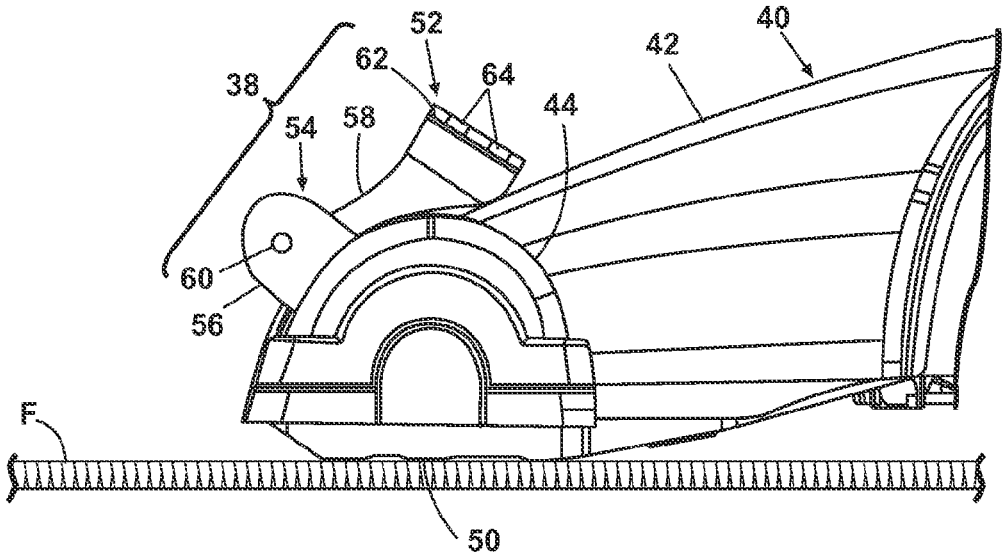
FIG. 10 is a side view of the vacuum cleaner base assembly from FIG. 8, where the carpet brush is in a non-use position.
Figure 11:
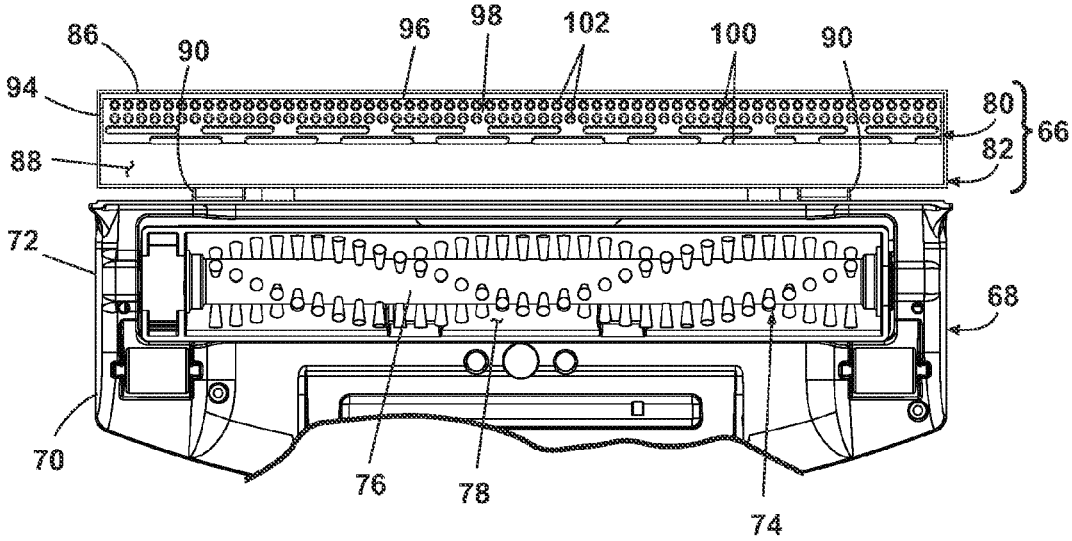
FIG. 11 is a bottom view of a vacuum cleaner base assembly comprising a movable hair collection assembly in accordance with a fourth embodiment of the invention, where the hair collection assembly is in a use-position.

Referring to FIGS. 8-10, a third embodiment of the invention is shown, where a movable hair collection assembly 38 is provided on a vacuum cleaner base assembly 40 of a typical upright vacuum cleaner, although the invention is equally effective on canister or stick type vacuum cleaners also. The base assembly 40 comprises a housing 42 having an agitator chamber 44 formed at a forward portion thereof, which houses a commonly known agitator assembly 46 in the form of a rotatable brushroll 48 for agitating the surface to be cleaned, however it can be appreciated that the invention can be practiced with or without an agitator assembly 46. A suction nozzle 50 is formed at a lower portion of the agitator chamber 44 and is in fluid communication with a remote suction source, as is commonly found in an upright vacuum cleaner.

The hair collection assembly 38 comprises a hair collection element 52 and a mounting assembly 54 for attaching the hair collection element 52 to the base assembly 40. The mounting assembly 54 comprises a pair of spaced brackets 56 (only one is visible in FIGS. 9-10) affixed or otherwise formed on the base assembly housing 42, preferably on the agitator chamber 44, and a corresponding support arm 58 rotatably coupled with each bracket 56 by a pivot coupling 60.

The hair collection element 52 is attached to or otherwise supported by the support arms 58 and extends substantially across the width of the front portion of the base assembly 40. The hair collection element 52 comprises an elongated support 62 and a plurality of spaced projections 64 depending therefrom. As illustrated, the hair collection element 52 is similar to the bottom portion 20 of the first embodiment. The projections 64 are arranged in a plurality of parallel rows extending across the support 62. The projections 64 in each row are aligned and are axially spaced from each other. Adjacent rows of projections 64 are offset from each other, whereby axial spaces S between adjacent projections 64 in one row are juxtaposed to projections 64 in an adjacent row. Preferably, the projections 64 are formed of an elastomeric material. More preferably, both the projections 64 and the support 62 are formed of an elastomeric material. The hair collection element 52 can alternately comprise a hair collector that is shown and described in the first embodiment. For example, the projections 64 can be shaped or arranged differently, or the material can be different.

Referring to FIGS. 9 and 10, the hair collection assembly 38 is manually movable between a use position, shown in FIG. 9, in which the hair collection element 52 is in contact with the surface to be cleaned F, and a non-use position, shown in FIG. 10, in which the hair collection element 52 is spaced from the surface to be cleaned F. In the use position, the hair collection element 52 is positioned forwardly of the suction nozzle 50 and is configured to dig against the surface to be cleaned F as the base assembly 40 is moved over it. To move to the non-use position, the support arms 58 are rotated about the pivot coupling 60 with the brackets 56 until the support arms 58 and/or the hair collection element 52 rests against an upper surface of the base assembly housing 42. Preferably, the support arms 58 rest against an upper surface of the agitator chamber 44.

In operation, to collect hair and/or other small debris, the vacuum cleaner base assembly 40 is moved forward and rearward in a reciprocating fashion over the surface to be cleaned using a common handle assembly that can be pivotally attached to the base assembly 40, with the hair collection assembly 38 in the use position. In the use position, the hair collection assembly 38 digs against the surface to be cleaned, thereby collecting hair and/or other small debris. At the end of each forward and rearward stroke, a pile of collected hair and/or debris accumulates, which can then be picked up through the suction nozzle 50. When hair collection is not desired, the vacuum cleaner can be used with the hair collection assembly 38 in the non-use position. The hair collection assembly 38 can also be moved to the non-use position to pick up the pile of collection hair and/or debris manually or though the suction nozzle 50.

Referring to FIGS. 11-14, a fourth embodiment of the invention is shown, where a movable hair collection assembly 66 is provided on a vacuum cleaner base assembly 68 of a typical upright vacuum cleaner, although the invention is equally effective on canister or stick type vacuum cleaners also. The base assembly 68 comprises a housing 70 having an agitator chamber 72 formed at a forward portion thereof, which houses a commonly known agitator assembly 74 in the form of a rotatable brushroll 76 for agitating the surface to be cleaned, however it can be appreciated that the invention can be practiced with or without an agitator assembly 74. A suction nozzle 78 is formed at a lower portion of the agitator chamber 74 and is in fluid communication with a remote suction source, as is commonly found in an upright vacuum cleaner.

The hair collection assembly 66 comprises a hair collection element 80 and a mounting assembly 82 for attaching the hair collection element 80 to the base assembly 68. The mounting assembly 82 comprises a pair of spaced brackets 84 (only one is visible in FIG. 12) affixed or otherwise formed on the base assembly housing 70, and preferably on the agitator chamber 72. An elongated casing 86 having a cavity 88 is configured to at least partially receive the hair collection element 80 and a pair of spaced support arms 90 formed on or otherwise attached to the casing 86 are rotatably coupled with each bracket 84 by a pivot coupling 92. The hair collection element 80 is rotatably coupled within the cavity 88 by a shaft 94 mounted to the casing 86.

The hair collection element 80 comprises an elongated support 96 having a curved face 98 and a plurality of spaced projections 100, 102 depending from the curved face 98. The projections 100, 102 are arranged in a plurality of parallel rows extending across the support 96. As illustrated, the projections 100, 102 are arranged in four rows, where the forwardmost two rows comprise longer projections, and the rearwardmost two rows comprise shorter, elongated projections. The projections 100, 102 adjacent rows are aligned. Preferably, at least the projections 100, 102 are formed of an elastomeric material. More preferably, both the projections 100, 102 and the support 96 are formed of an elastomeric material. Other configurations of the hair collection element 80 are possible such as combining the oval protrusions described in the first embodiment with rake teeth and the like.

Figure 12:
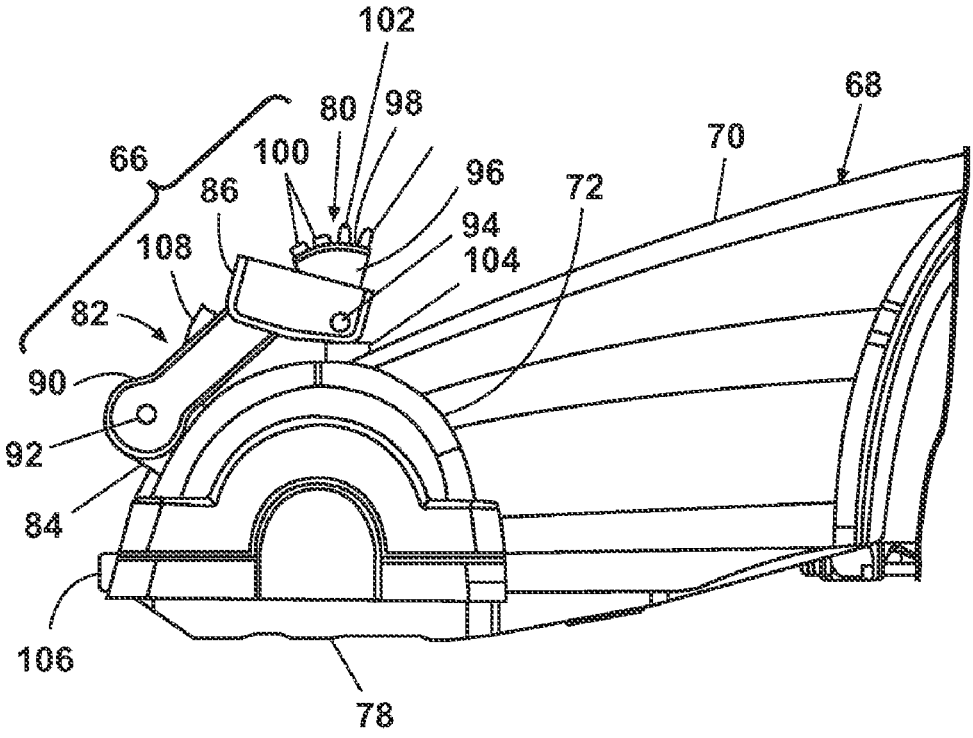
FIG. 12 is a side view of the vacuum cleaner base assembly from FIG. 11, where the hair collection assembly is in a non-use position.
Figure 13:
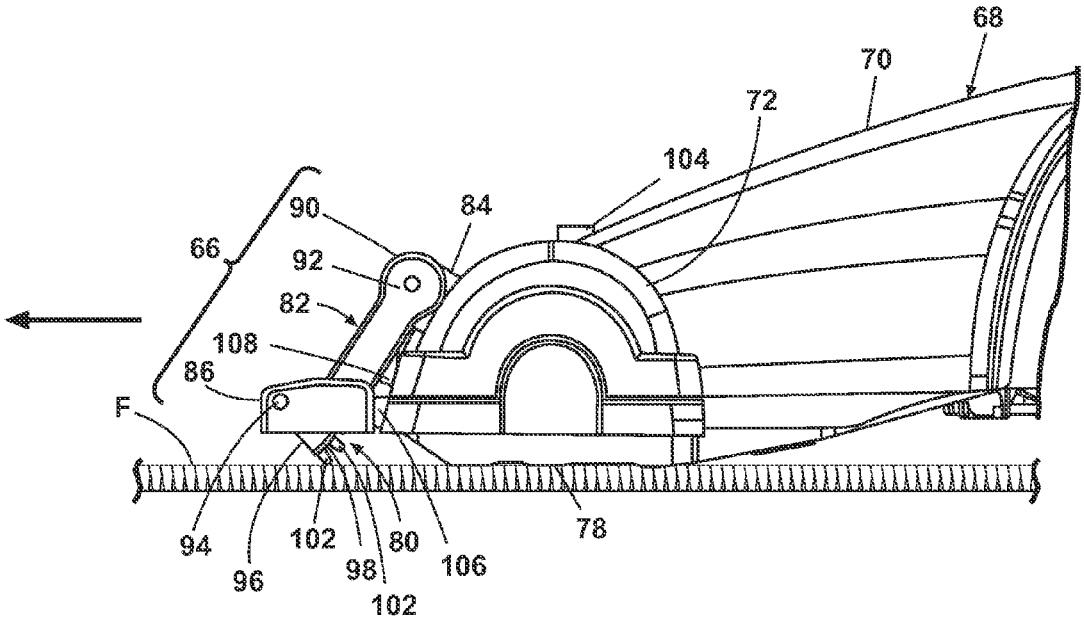
FIG. 13 is a side view of the vacuum cleaner base assembly from FIG. 11, where the vacuum cleaner base assembly is moving in a forward direction across a surface to be cleaned.
Figure 14:
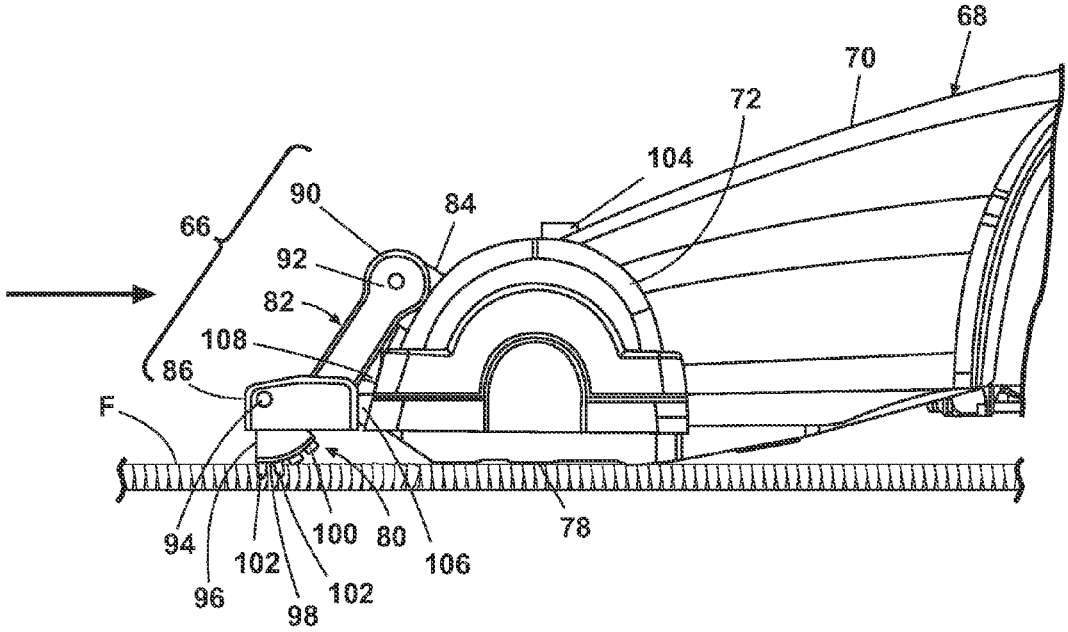
FIG. 14 is a view similar to FIG. 13, where the vacuum cleaner base assembly is moving a rearward direction across a surface to be cleaned.

Referring to FIGS. 12-14, the hair collection assembly 66 is manually movable between a non-use position, shown in FIG. 12, in which the hair collection element 80 is spaced from the surface to be cleaned F, and a use position, shown in FIGS. 13 and 14, in which the hair collection element 80 is in contact with the surface to be cleaned F. To move from the use position to the non-use position, the support arms 90 are rotated about the pivot coupling 92 with the brackets 84 until the support arms 90 and/or the casing 86 rests against an upper surface of the base assembly housing 70. To prevent damage to the hair collection assembly 66 or the base assembly 68 when moving between the use and non-use positions, a first stop 104 is provided on the housing 70 on which the casing 86 will rest in the non-use position, a second stop 106 is provided on the front surface of the agitator chamber 72 against which the casing 86 will rest in the use position, and a third stop 108 is provided on each of the support arms 90 which contacts the front surface of the agitator chamber 72 in the use position.

In the use position, the hair collection element 80 is positioned forwardly of the suction nozzle 78 and is configured to glide or skim over the surface to be cleaned F as the base assembly 68 is moved in a forward direction, as shown in FIG. 13, and to press or dig against the surface to be cleaned F as the base assembly 68 is moved in a rearward direction, as shown in FIG. 14. On each rearward stroke of the base assembly 68, friction between the long projections 102 and the surface to be cleaned F causes the support 96 to rotate about the shaft 94 in a clockwise direction with respect to the orientation of FIGS. 13-14. In this position, contact between the hair collection element 80 and the surface to be cleaned F is maximized, thus requiring more pull effort to be exerted by the user. As the projections 100, 102 dig against the surface to be cleaned F, hair and/or other small debris will be collected. At the end of the rearward stroke, a pile of collected hair and debris will accumulate. On each forward stroke of the base assembly 68, friction between the long projections 102 and the surface to be cleaned F causes the support 96 to rotate about the shaft 94 in a counterclockwise direction with respect to the orientation of FIGS. 13-14. In this position, contact between the hair collection element 80 and the surface to be cleaned F is minimized, thus requiring less push effort to be exerted by the user. Furthermore, little to no hair and/or other small debris is collection by the hair collection element 80 on the forward stroke.

In operation, to collect hair and/or other small debris, the vacuum cleaner base assembly 68 is moved forwards and rearwards in a back and forth motion over the surface to be cleaned using a common handle assembly that can be pivotally attached to the base assembly 68, with the hair collection assembly 66 in the use position. In the use position, the hair collection element 80 digs against the surface to be cleaned as the base assembly 68 is moved in a rearward direction, thereby collecting hair and/or other small debris. At the end of each rearward stroke, a pile of collected hair and/or debris accumulates, which can then be picked up through the suction nozzle 78 as the base assembly 68 in moved in a forward direction.

Referring to FIGS. 15-18, a fifth embodiment of the invention is shown, where a movable hair collection assembly 110 is provided on a vacuum cleaner base assembly 112 of a typical upright vacuum cleaner, although the invention is equally effective on canister or stick type vacuum cleaners also. The base assembly 112 comprises a housing 114 having an agitator chamber 116 formed at a forward portion thereof, which houses a commonly known agitator assembly (not shown) for agitating the surface to be cleaned, however it can be appreciated that the invention can be practiced with or without an agitator assembly. A suction nozzle 118 is formed at a lower portion of the agitator chamber 116 and is in fluid communication with a remote suction source, as is commonly found in an upright vacuum cleaner.

The hair collection assembly 110 comprises a hair collection element 120 and a mounting assembly 122 for attaching the hair collection element 120 to the base assembly 112. The mounting assembly 122 comprises a bracket 124 that is rotatably coupled with the base assembly 112, preferably at the front surface of the agitator chamber 116, by a first pivot coupling 126. A second pivot coupling 128 rotatably couples the bracket 124 and the hair collection element 120.

The hair collection element 120 extends substantially across the width of the front portion of the base assembly 112 and comprises an elongated support 130 and a plurality of spaced projections 132 depending from the support. The hair collection element 120 is preferably similar to the bottom portion 20 of the first embodiment, although other configurations can be used.

Figure 15:
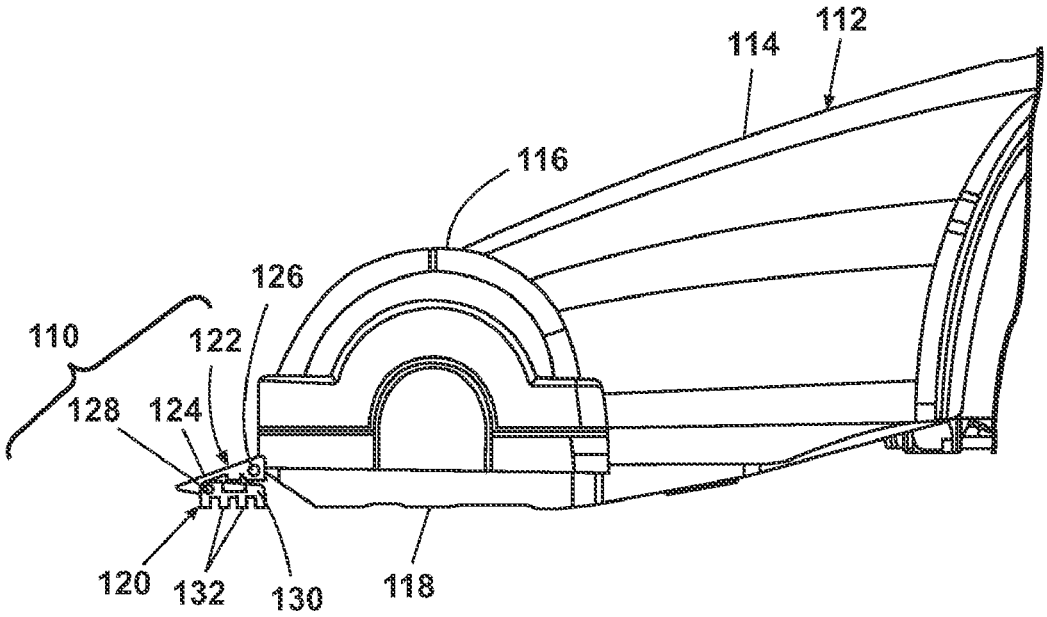
FIG. 15 is a side view of a vacuum cleaner base assembly comprising a movable hair collection assembly in accordance with a fifth embodiment of the invention, where the hair collection assembly is in a use-position.
Figure 16:
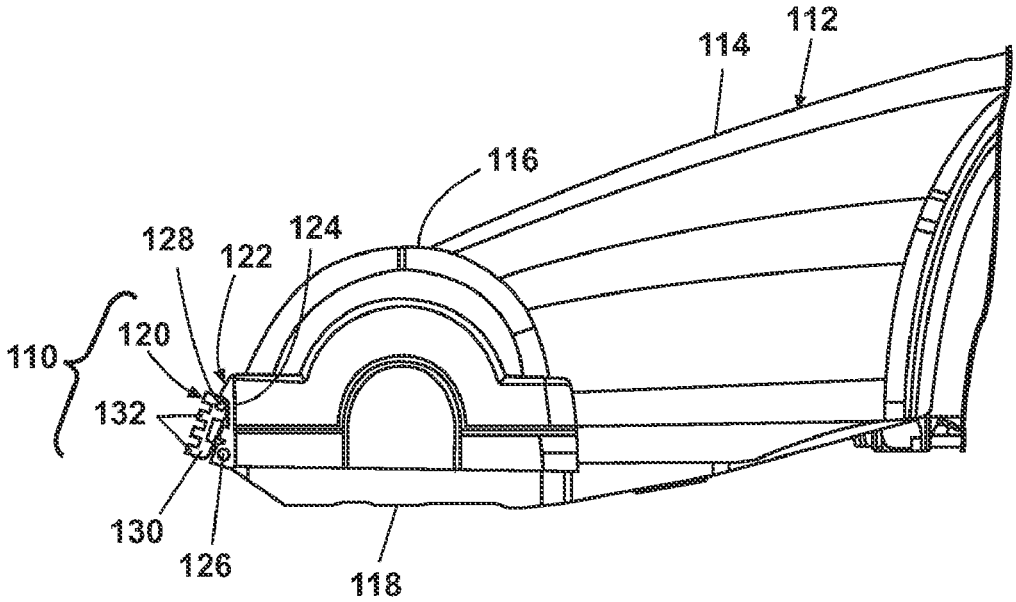
FIG. 16 is a side view of the vacuum cleaner base assembly from FIG. 15, where the hair collection assembly is in a non-use position.

Referring to FIGS. 15-16, the hair collection assembly 110 is manually movable between a use position, shown in FIG. 15, in which the hair collection element 120 is in contact with the surface to be cleaned F and a non-use position, shown in FIG. 16, in which the hair collection element 120 is spaced from the surface to be cleaned F. To move from the use position to the non-use position, the bracket 124 is rotated about the first pivot coupling 126 until the bracket 124 rests against the agitator chamber 116. Furthermore, in the non-use position, the hair collection element 120 has the added utility of acting as a front bumper for the base assembly 112 as the hair collection element 120 is made of a soft elastomeric material that will not damage furniture or other obstacles it contacts.

Figure 17:
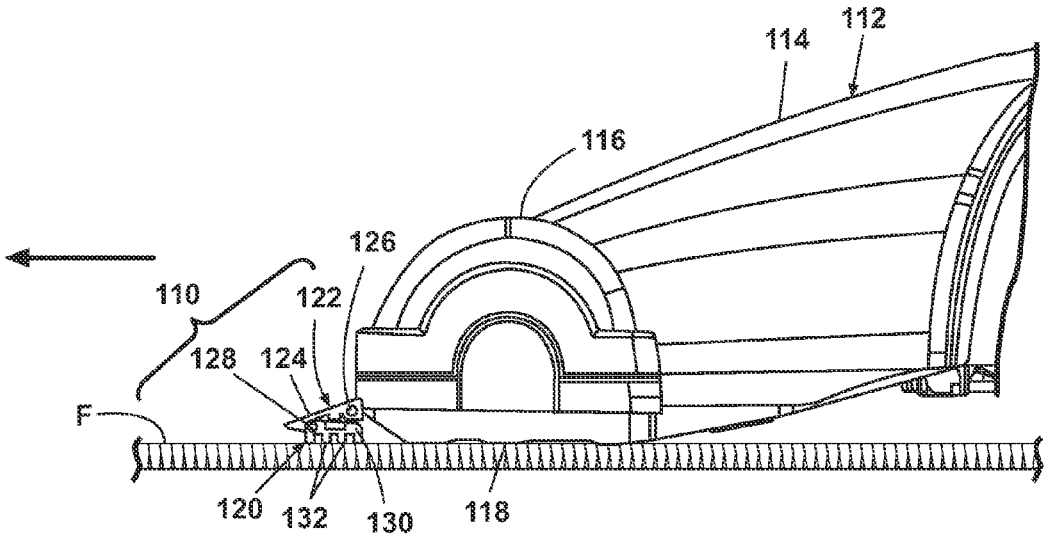
FIG. 17 is a view similar to FIG. 15, where the vacuum cleaner base assembly is moving in a forward direction across a surface to be cleaned.
Figure 18:
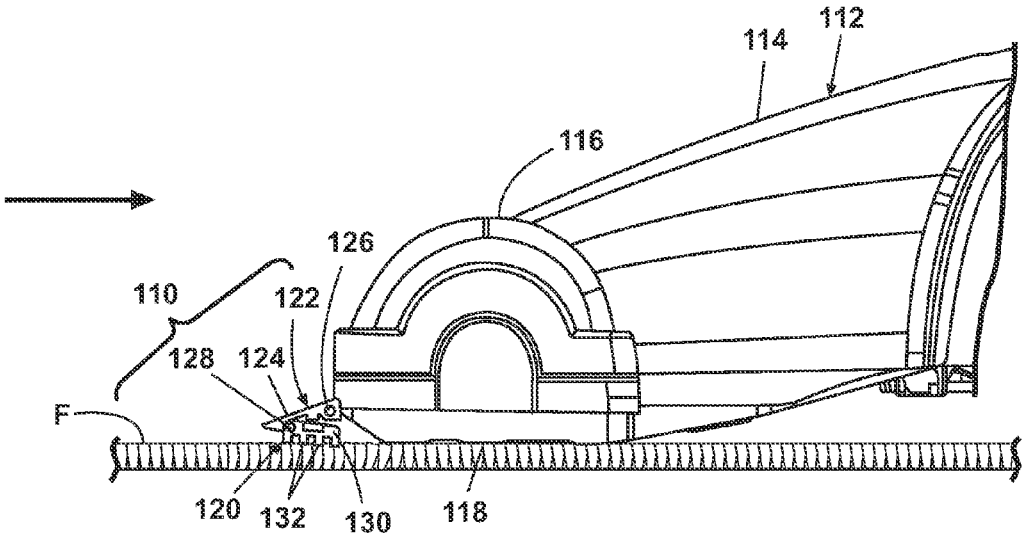
FIG. 18 is a view similar to FIG. 15, where the vacuum cleaner base assembly is moving a rearward direction across a surface to be cleaned.

Referring to FIGS. 17 and 18, in the use position, the hair collection element 120 is positioned forwardly of the suction nozzle 118 and is configured to glide or skim over the surface to be cleaned F as the base assembly 112 is moved in a forward direction, as shown in FIG. 17, and to press or dig against the surface to be cleaned F as the base assembly 112 is moved in a rearward direction, as shown in FIG. 18. On each rearward stroke of the base assembly 112, friction between the projections 132 and the surface to be cleaned F causes the support 130 to rotate about the second pivot coupling 128 in a clockwise direction with respect to the orientation of FIGS. 17-18. In this position, friction between the hair collection element 120 and the surface to be cleaned F is maximized, thus requiring more pull effort to be exerted by the user. As the projections 132 dig against the surface to be cleaned F, hair and/or other small debris will be collected. At the end of the rearward stroke, a pile of collected hair and debris will accumulate. On each forward stroke of the base assembly 112, friction between the projections 132 and the surface to be cleaned F causes the support 130 to rotate about the second pivot coupling 128 in a counterclockwise direction with respect to the orientation of FIGS. 17-18. In this position, contact between the hair collection element 120 and the surface to be cleaned F is minimized, thus requiring less push effort to be exerted by the user. Furthermore, little to no hair and/or other small debris is collection by the hair collection element 120 on the forward stroke.

In operation, to collect hair and/or other small debris, the vacuum cleaner base assembly 112 is moved forwards and rearwards in a reciprocating fashion over the surface to be cleaned using a common handle assembly that can be pivotally attached to the base assembly 112, with the hair collection assembly 110 in the use position. In the use position, the hair collection element 80 digs against the surface to be cleaned as the base assembly 112 is moved in a rearward direction, thereby collecting hair and/or other small debris. At the end of each rearward stroke, a pile of collected hair and/or debris accumulates, which can then be picked up through the suction nozzle 118 as the base assembly 112 in moved in a forward direction.

Figure 19:
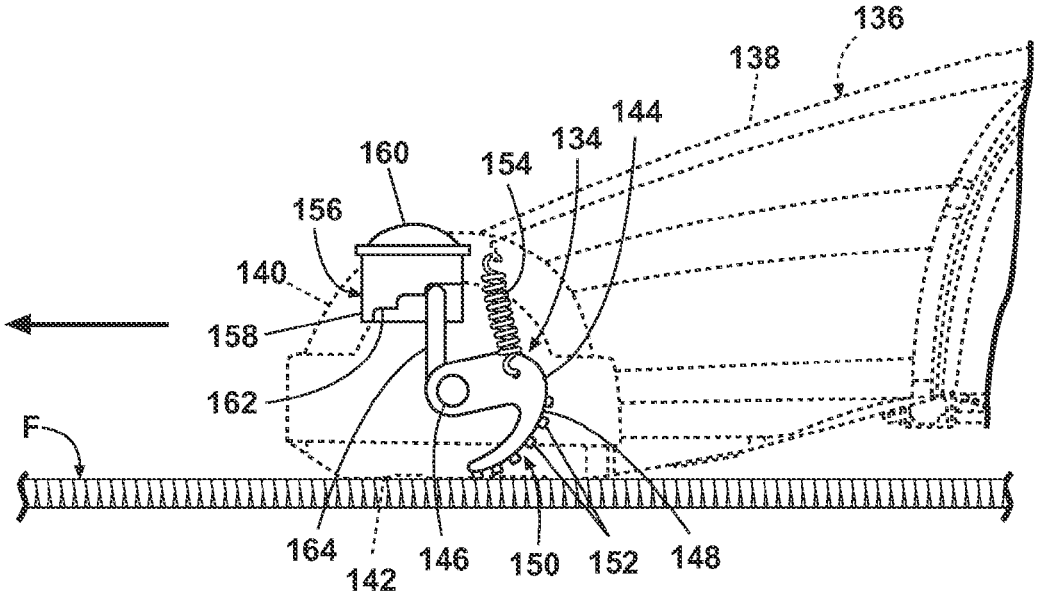
FIG. 19 is a view of a vacuum cleaner base assembly comprising a movable hair collection assembly in accordance with a sixth embodiment of the invention, where the vacuum cleaner base assembly is moving in a forward direction across a surface to be cleaned.
Figure 20:
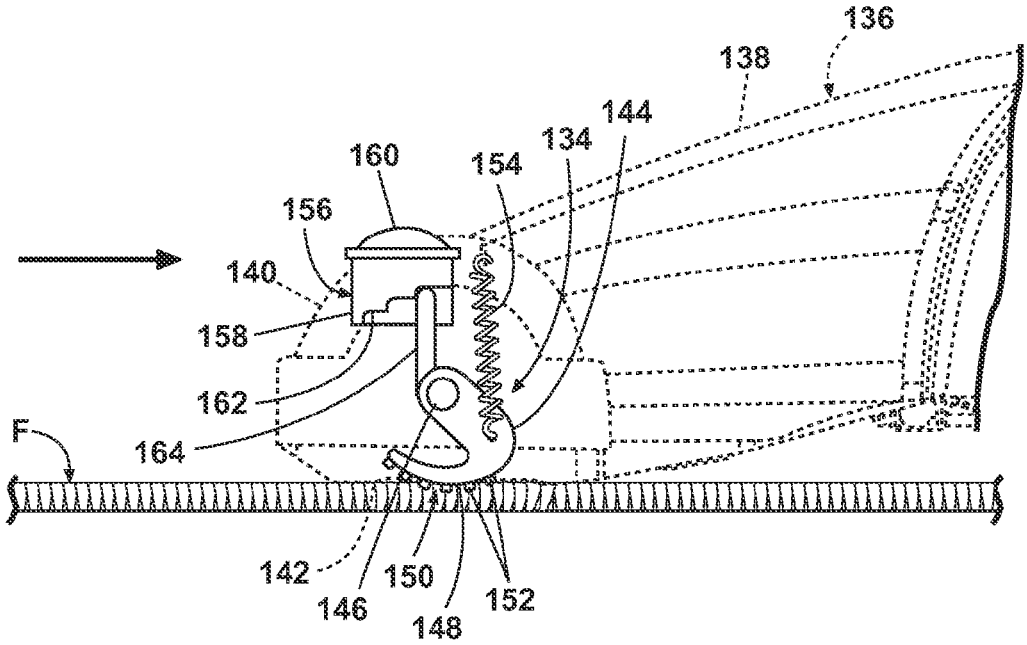
FIG. 20 is a view similar to FIG. 19, where the vacuum cleaner base assembly is moving a rearward direction across a surface to be cleaned.
Figure 21:
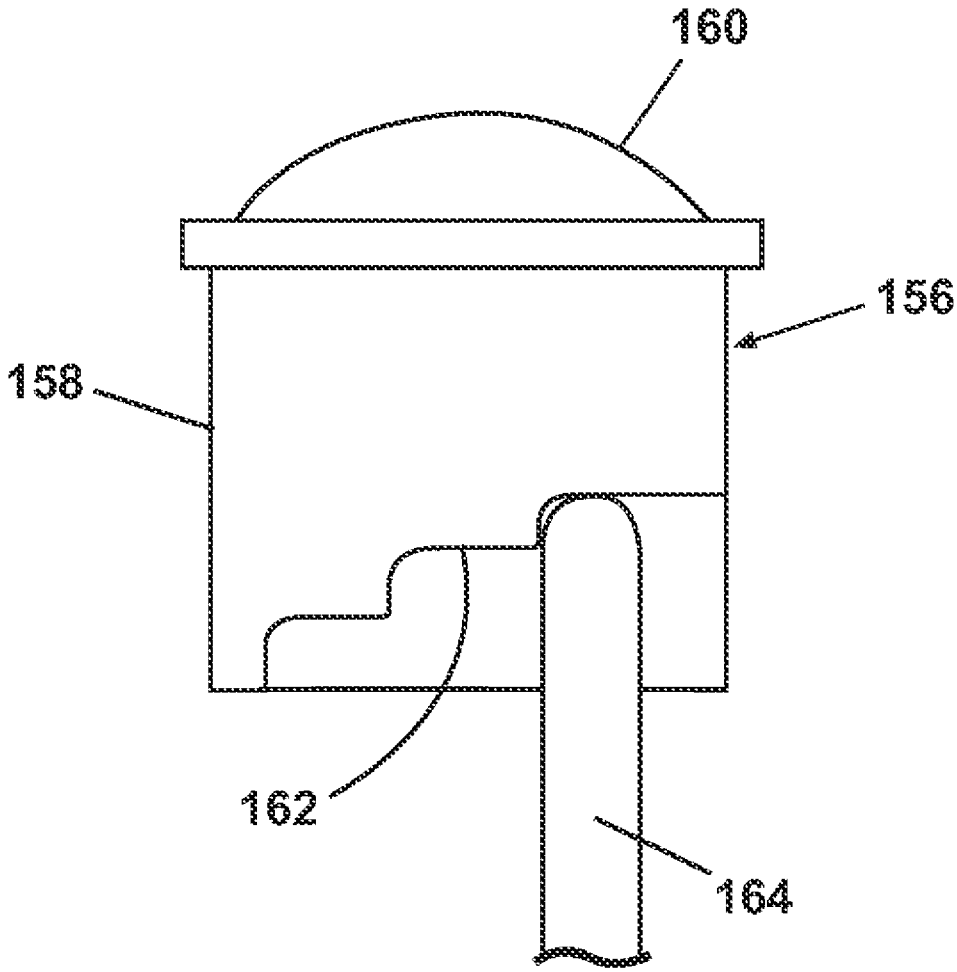
FIG. 21 is a view of a height adjustment knob for the hair collection assembly from FIG. 19.
Figure 22:
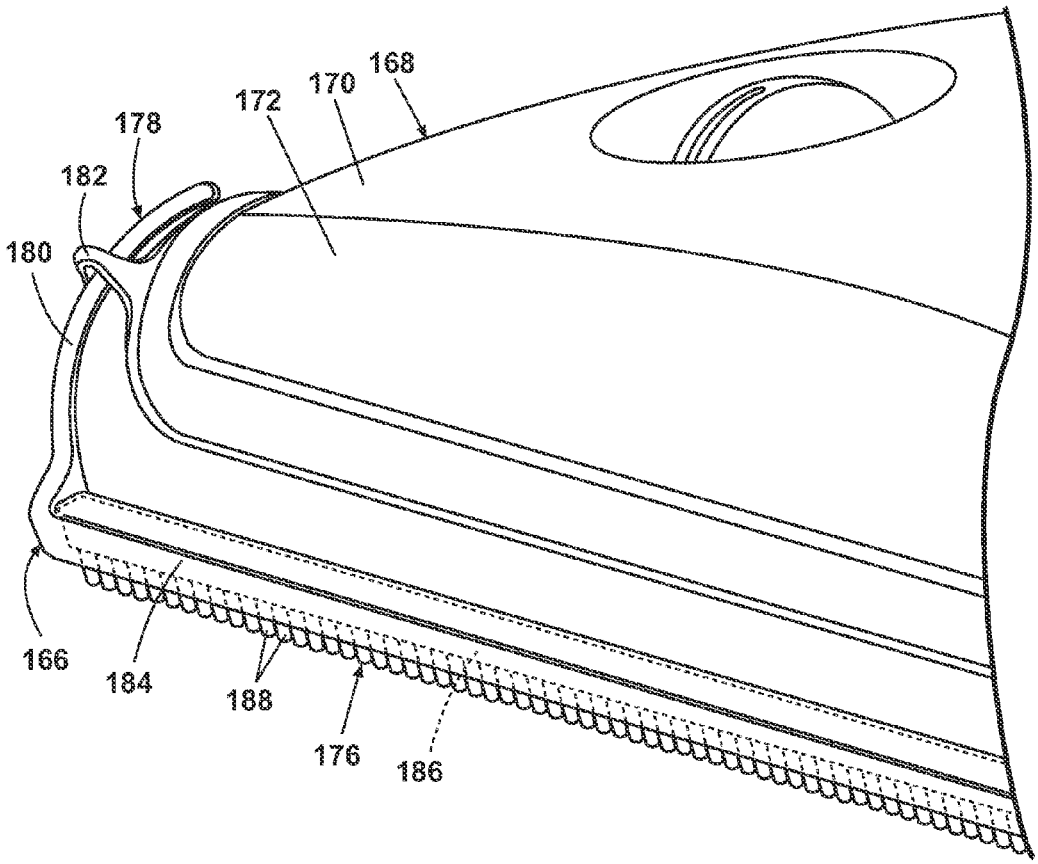
FIG. 22 is a partial perspective view of a vacuum cleaner base assembly comprising a movable hair collection assembly in accordance with a seventh embodiment of the invention.

Referring to FIGS. 19-21, a sixth embodiment of the invention is shown, where a hair collection assembly 134 is provided on a vacuum cleaner base assembly 136 (shown in phantom for illustration purposes) of a typical upright vacuum cleaner, although the invention is equally effective on canister or stick type vacuum cleaners also. The base assembly 136 comprises a housing 138 having an agitator chamber 140 formed at a forward portion thereof, which houses a commonly known agitator assembly (not shown) for agitating the surface to be cleaned, however it can be appreciated that the invention can be practiced with or without an agitator assembly. Preferably, the hair collection assembly 134 is positioned within the agitator chamber 140, forwardly of the agitator assembly. A suction nozzle 142 is formed at a lower portion of the agitator chamber 140 and is in fluid communication with a remote suction source, as is commonly found in an upright vacuum cleaner.

The hair collection assembly 134 comprises a bar 144 rotatably coupled to a shaft 146 extending through the agitator chamber 140. The bar 144 comprises a curved surface 148 having a hair collection element 150 in the form of multiple projections 152 extending from the curved surface 148. The bar 144 further is biased to the position shown in FIG. 19 by a spring 154 attached between the bar 144 and the base assembly housing 138.

The hair collection assembly 134 can be adjusted according to the type of surface being cleaned, i.e. according to the height of the carpet pile. A control knob 156, is provided for manually selecting the type of surface being cleaned. The control knob 156 comprises a cylindrical body 158 having a user-engageable portion 160 which extends exteriorly of the base assembly housing 138 and a cam curve portion 162 formed opposite the user-engageable portion 160. The cam curve portion 162 rides up and down on a rod 164 that extend upwardly from the shaft 146. The rod 164 is fixed to or integrally formed with the shaft 146 so that that shaft 146 will be forced towards or lifted away from the surface to be cleaned F when the control knob 156 is rotated accordingly. While not illustrated, the height adjustment mechanism for the hair collection assembly 134 can be combined with a nozzle height adjustment mechanism for adjusting the distance between the suction nozzle 142 and the surface to be cleaned F. For example, the control knob 156 can be combined with a commonly known nozzle height adjustment mechanism so that both the nozzle height and hair collection assembly 134 can be simultaneously adjusted.

The hair collection element 150 is configured to glide or skim over the surface to be cleaned F as the base assembly 136 is moved in a forward direction, as shown in FIG. 19, and to press or dig against the surface to be cleaned F as the base assembly 136 is moved in a rearward direction, as shown in FIG. 20. On each rearward stroke of the base assembly 136, friction between the projections 152 and the surface to be cleaned F causes the bar 144 to rotate about the shaft 146 in a clockwise direction with respect to the orientation of FIGS. 19-20. In this position, contact between the hair collection element 150 and the surface to be cleaned F is maximized, thus requiring more pull effort to be exerted by the user. As the projections 152 dig against the surface to be cleaned F, hair and/or other small debris will be collected. At the end of the rearward stroke, a pile of collected hair and debris will accumulate. On each forward stroke of the base assembly 136, the geometry of the hair collection assembly 134 with respect to the surface to be cleaned F causes the bar 144 to rotate about the shaft 146 in a counterclockwise direction with respect to the orientation of FIGS. 19-20. This rotation is aided by the spring 154, which biases the plate 144 to the position shown in FIG. 19. In this position, contact between the hair collection element 150 and the surface to be cleaned F is minimized, thus requiring less push effort to be exerted by the user. Furthermore, little to no hair and/or other small debris is collection by the hair collection element 150 on the forward stroke.

Alternately, the hair collection assembly 134 can be mounted within the base assembly 136 such that the hair collection element 150 is configured to glide or skim over the surface to be cleaned F as the base assembly 136 is moved in a rearward direction and to press or dig against the surface to be cleaned F as the base assembly 136 is moved in a forward direction.

In operation, the user first selects what type of surface is to be cleaned using the control knob 156. Markings can be provided on the control knob 156 and/or the base assembly housing 138 to indicate the surface type options. The vacuum cleaner base assembly 136 is moved forwards and rearwards in a reciprocating fashion over the surface to be cleaned using a common handle assembly that is pivotally attached to the base assembly 136. The hair collection element 150 digs against the surface to be cleaned as the base assembly 136 is moved in a rearward direction, thereby collecting hair and/or other small debris. At the end of each rearward stroke, a pile of collected hair and/or debris accumulates, which can then be picked up through the suction nozzle 142 as the base assembly 136 in moved in a forward direction.

Referring to FIGS. 22-25, a seventh embodiment of the invention is shown, where a movable hair collection assembly 166 is provided on a vacuum cleaner base assembly 168 of a typical upright vacuum cleaner, although the invention is equally effective on canister or stick type vacuum cleaners also. The base assembly 168 comprises a housing 170 having an agitator chamber 172 formed at a forward portion thereof, which houses a commonly known agitator assembly (not shown) for agitating the surface to be cleaned, however it can be appreciated that the invention can be practiced with or without an agitator assembly. A suction nozzle 174 is formed at a lower portion of the agitator chamber 172 and is in fluid communication with a remote suction source, as is commonly found in an upright vacuum cleaner.

The hair collection assembly 166 comprises a hair collection element 176 and a mounting assembly 178 for attaching the hair collection element 176 to the base assembly 168. The mounting assembly 178 comprises a pair of spaced arms 180 (only one is visible in FIG. 22) slidably mounted within an arm receiver 182 formed on either end of the agitator chamber 172. A hair collection element mounting bar 184 extends between the arms and supports the hair collection element 176.

The hair collection element 176 comprises an elongated support 186 having a plurality of projections 188 depending from the support 186. As illustrated, the projections 188 are arranged in the single row extending across the support 186. Preferably, at least the projections 188 are formed of an elastomeric material. More preferably, both the projections 188 and the support 186 are formed of an elastomeric material. Other configurations of the hair collection element 176 are possible. For example, a single continuous blade can be used in place of multiple separate projections.

Figure 23:
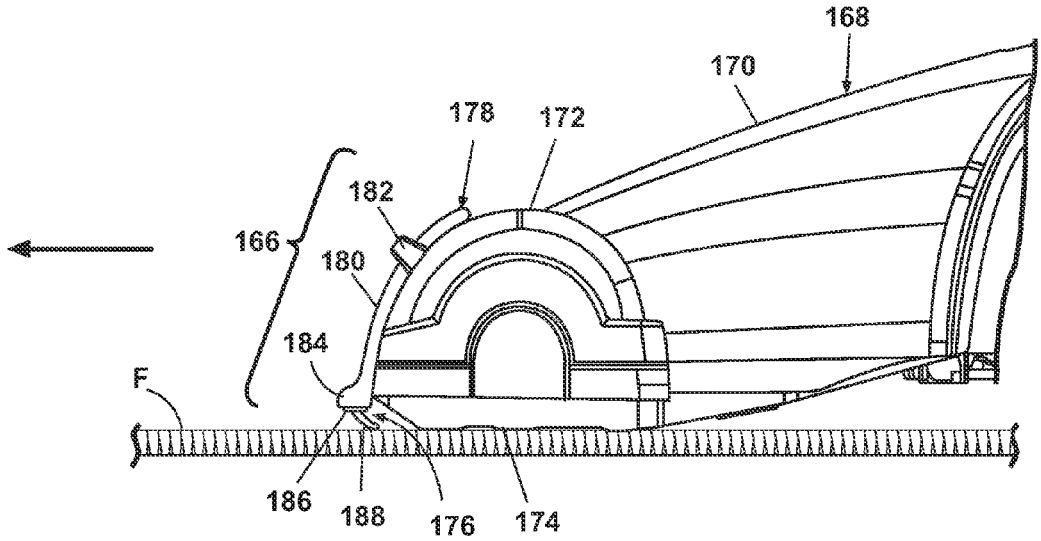
FIG. 23 is a side view of the base assembly from FIG. 22, where the hair collection assembly is in a use position and the vacuum cleaner base assembly is moving in a forward direction across a surface to be cleaned.
Figure 24:
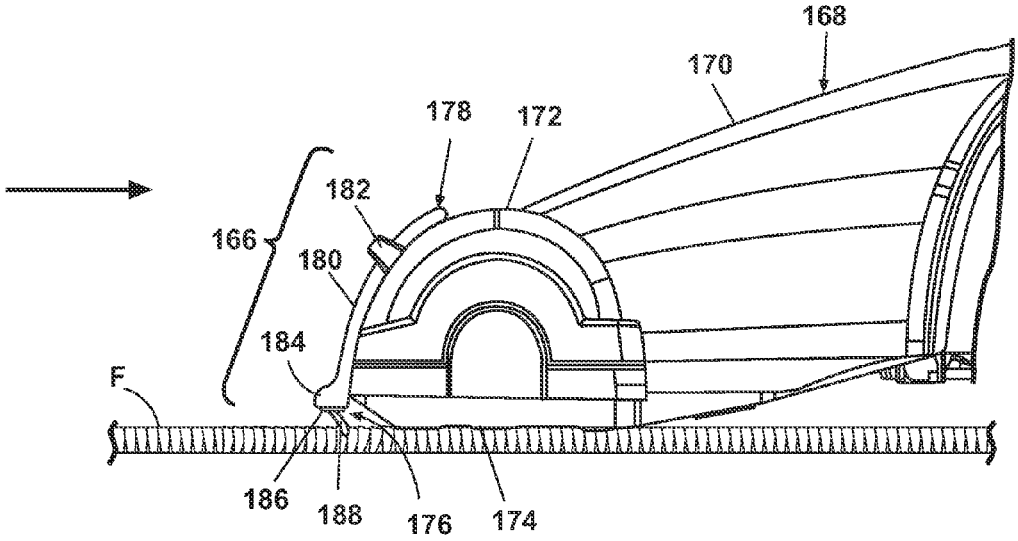
FIG. 24 is a view similar to FIG. 23, where the vacuum cleaner base assembly is moving a rearward direction across a surface to be cleaned.
Figure 25:
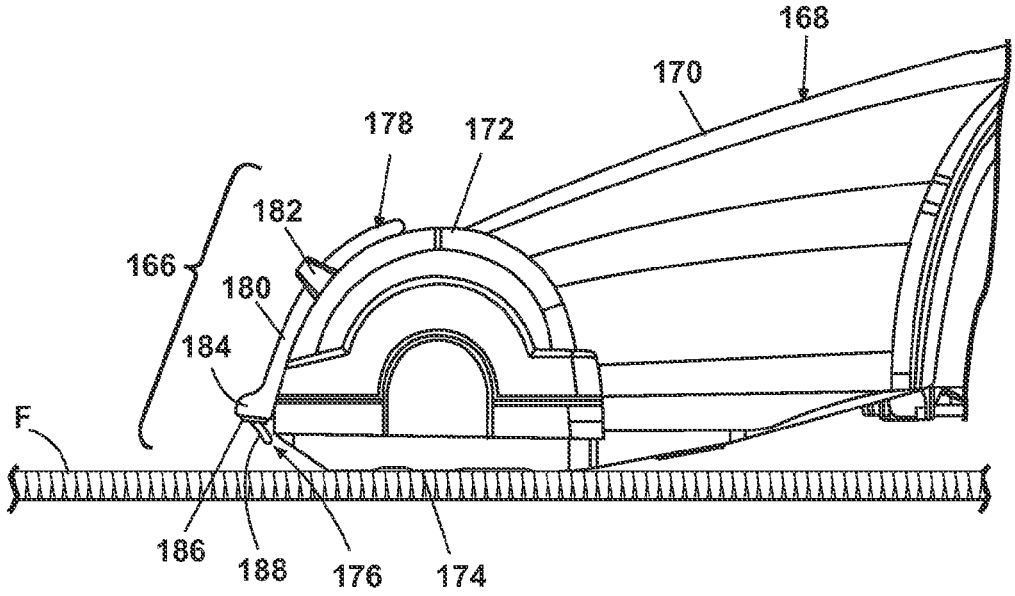
FIG. 25 is a view similar to FIG. 23, where the hair collection assembly is in a non-use position.
Figure 26:
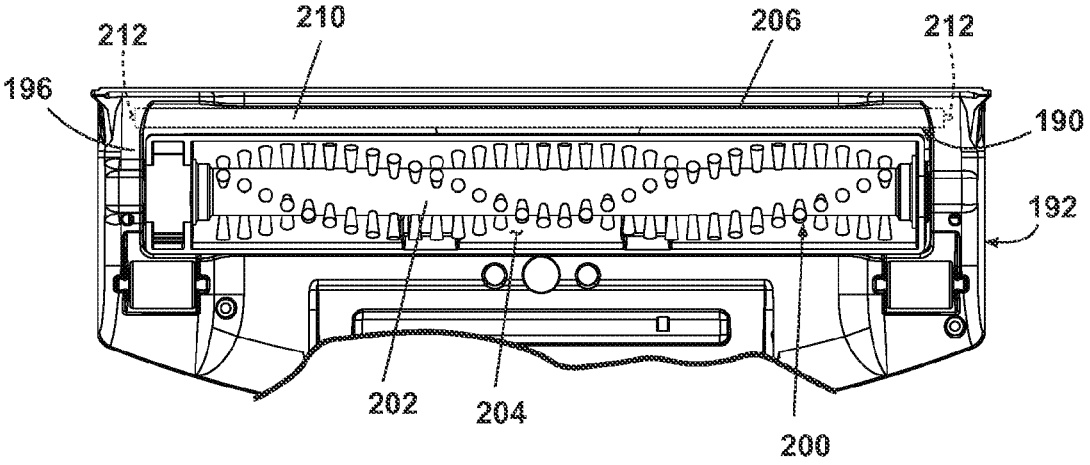
FIG. 26 is a bottom perspective view of a vacuum cleaner base assembly comprising a hair collection assembly in accordance with an eighth embodiment of the invention.
Figure 27:
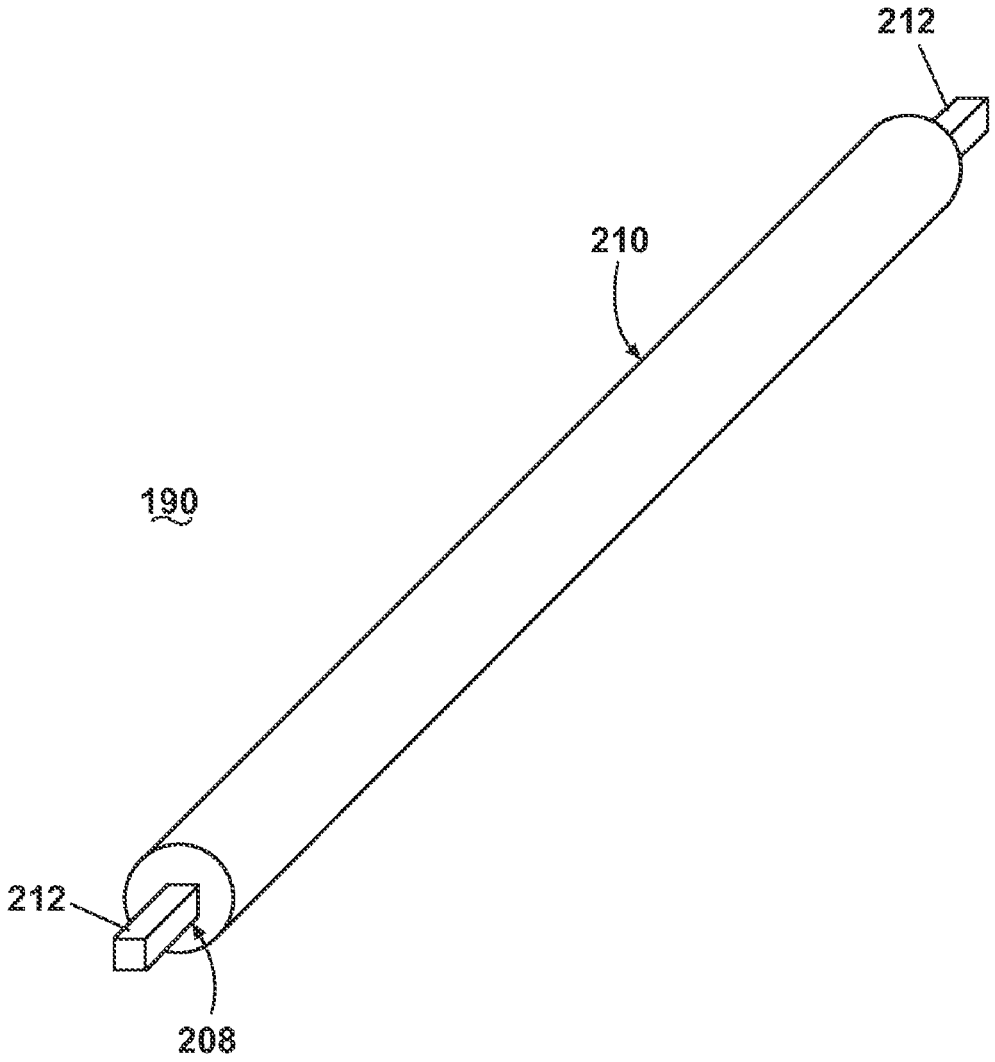
FIG. 27 is a perspective view of the hair collection assembly from FIG. 26.

Referring to FIGS. 23-25, the hair collection assembly 166 is manually movable between a non-use position, shown in FIG. 25, in which the hair collection element 176 is spaced from the surface to be cleaned F, and a use position, shown in FIGS. 23 and 24, in which the hair collection element 176 is in contact with the surface to be cleaned F. To move from the use position to the non-use position, the arms 180 are slid upwardly within the arm receivers 182 and locked or otherwise retained in an orientation where the hair collection element 176 is spaced from the surface to be cleaned F.

In the use position, the hair collection element 176 is positioned forwardly of the suction nozzle 174 and is configured to glide or skim over the surface to be cleaned F as the base assembly 168 is moved in a forward direction, as shown in FIG. 23, and to press or dig against the surface to be cleaned F as the base assembly 168 is moved in a rearward direction, as shown in FIG. 24. In the use position, the projections 188 contact the surface to be cleaned F at an acute angle, such that the projections extend from the support 186 in a generally rearward direction. Preferably, the projections 188 are orientated at roughly a 45° angle with respect to the surface to be cleaned F.

On each rearward stroke of the base assembly 168, the orientation of the projections 188 causes them to dig against the surface to be cleaned F. As the projections 188 dig against the surface to be cleaned F, hair and/or other small debris will be collected. At the end of the rearward stroke, a pile of collected hair and debris will accumulate. On each forward stroke of the base assembly 168, the orientation of the projections 188 causes them to glide or skim over the surface to be cleaned F. In this position, contact between the hair collection element 176 and the surface to be cleaned F is minimized, thus requiring less push effort than pull effort to be exerted by the user. Furthermore, little to no hair and/or other small debris is collection by the hair collection element 176 on the forward stroke.

In operation, to collect hair and/or other small debris, the vacuum cleaner base assembly 168 is moved forwards and rearwards in a reciprocating fashion over the surface to be cleaned using a common handle assembly that is pivotally attached to the base assembly 168, with the hair collection assembly 166 in the use position. As the base assembly 168 moved in a forward direction, the hair collection assembly 176 digs against the surface to be cleaned, thereby collecting hair and/or other small debris. At the end of each forward and rearward stroke, a pile of collected hair and/or debris accumulates, which can then be picked up through the suction nozzle 174. When hair collection is not desired, the vacuum cleaner can be used with the hair collection assembly 166 in the non-use position. The hair collection assembly 166 can also be moved to the non-use position to pick up the pile of collection hair and/or debris manually or though the suction nozzle 174.

Referring to FIGS. 26-29, a eighth embodiment of the invention is shown, where a hair collection assembly 190 is provided on a vacuum cleaner base assembly 192 of a typical upright vacuum cleaner, although the invention is equally effective on canister or stick type vacuum cleaners also. The base assembly 192 comprises a cover housing 194 and a sole plate 196. An agitator chamber 198 is formed at a forward portion of the cover housing 194, which houses a commonly known agitator assembly 200 in the form of a rotatable brushroll 202 for agitating the surface to be cleaned, however it can be appreciated that the invention can be practiced with or without an agitator assembly 200. The sole plate 196 has a suction nozzle 204 formed therein at a lower portion of the agitator chamber 198 and is in fluid communication with a remote suction source, as is commonly found in an upright vacuum cleaner. The sole plate 196 further has a curved cover flange 206 that at least partially covers the front portion of the hair collection assembly 190.

The hair collection assembly 190 comprises a rod 208 having a hair collection element 210 covering at least a portion of the rod 208, leaving the rod ends 212 exposed. Preferably, the hair collection element 210 is overmolded onto the rod 208. Alternatively, the hair collection element 210 is a polyurethane tube, where the inside diameter of the tube is sized to provide an interference fit with the outside diameter of the rod 208. However, the hair collection element 210 can be attached to the rod 208 in any suitable manner and can be made of any suitable elastomeric material as previously described.

The hair collection assembly 190 is snap fit into the sole plate 196, forwardly of the brushroll 202 so that a portion of the hair collection element 210 can contact the surface to be cleaned F through the suction nozzle 204. Although not illustrated, the sole plate 196 can have features that cooperate with the rod ends 212 to retain the hair collection assembly 190 on the base assembly 192 as is commonly employed with straight axle engagement mechanisms on vacuum cleaners and sweepers. As the hair collection assembly 190 is used, the portion of the hair collection element 210 that is in contact with the surface to be cleaned F can wear down and become less effective at collecting hair and/or other small debris. When this happens, the hair collection assembly 190 can be rotated to another orientation, preferably 90° from the prior position, and used again until unacceptable wear occurs, at which point the hair collection assembly 190 can be removed from the sole plate 196 and replaced with a new hair collection element 210 or entire hair collection assembly 190. As illustrated, the rod ends 212 have a square cross section, which allows the user to index the hair collection assembly 190 to four different orientations before having to replace the hair collection element 210 or the entire hair collection assembly 190.

Figure 28:
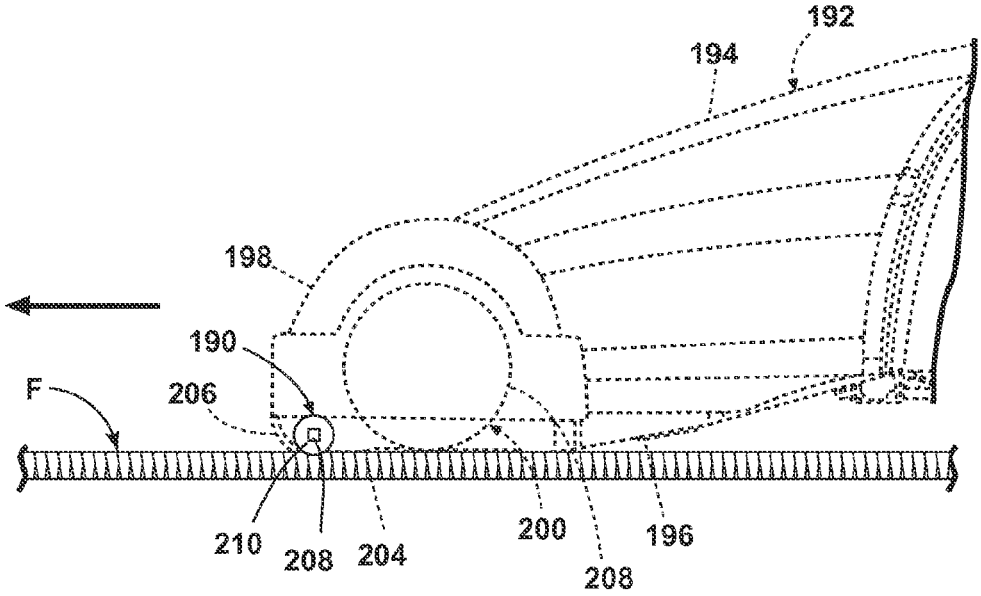
FIG. 28 is a side view of the base assembly from FIG. 26, where the base assembly is moving in a forward direction across a surface to be cleaned.
Figure 29:
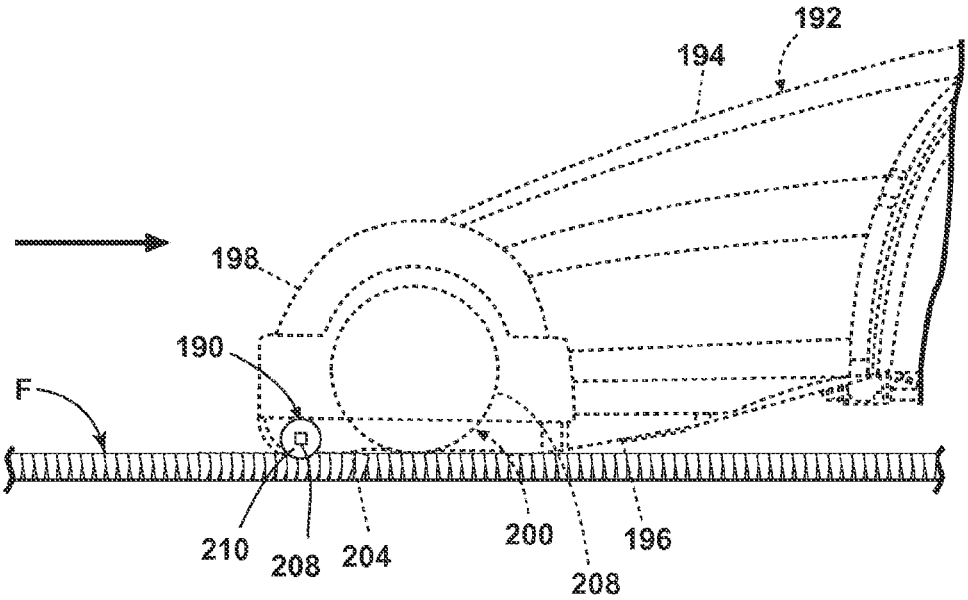
FIG. 29 is a side view similar to FIG. 28, where the base assembly is moving in a rearward direction across a surface to be cleaned.
Figure 30:
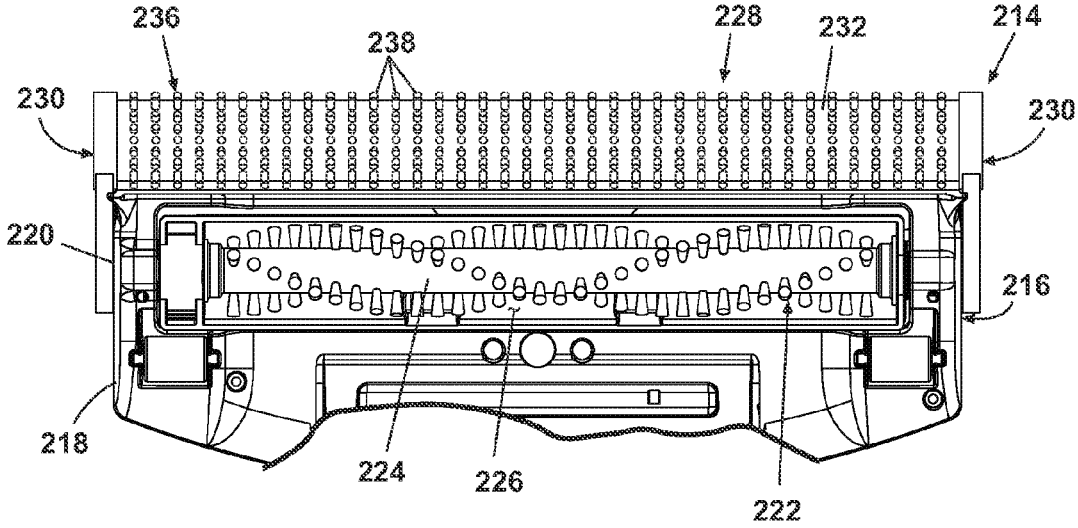
FIG. 30 is a bottom perspective view of a vacuum cleaner base assembly comprising a hair collection assembly in accordance with an ninth embodiment of the invention.

In operation, to collect hair and/or other small debris, the vacuum cleaner base assembly 192 is moved forwards and rearwards in a reciprocating fashion over the surface to be cleaned using a common handle assembly that is pivotally attached to the base assembly 192. As the base assembly 192 is moved in a rearward direction, as shown in FIG. 29, the hair collection element 210 digs against the surface to be cleaned thereby collecting hair and/or other small debris. At the end of each rearward stroke, a pile of collected hair and/or debris accumulates, which can then be picked up through the suction nozzle 204 as the base assembly 192 in moved in a forward direction. When moving in the forward direction, as shown in FIG. 28, the cover flange 206 of the sole plate 196 covers the leading portion of the hair collection element 210 so that minimal hair is collected on the forward stroke, and a relatively easy push effort is required from the user.

Referring to FIGS. 30-35, a ninth embodiment of the invention is shown, where a hair collection assembly 214 is provided on a vacuum cleaner base assembly 216 of a typical upright vacuum cleaner, although the invention is equally effective on canister or stick type vacuum cleaners also. The base assembly 216 comprises a housing 218 having an agitator chamber 220 formed at a forward portion thereof, which houses a commonly known agitator assembly 222 in the form of a rotatable brushroll 224 for agitating the surface to be cleaned, however it can be appreciated that the invention can be practiced with or without an agitator assembly 222. A suction nozzle 226 is formed at a lower portion of the agitator chamber 220 and is in fluid communication with a remote suction source, as is commonly found in an upright vacuum cleaner.

Figure 31:
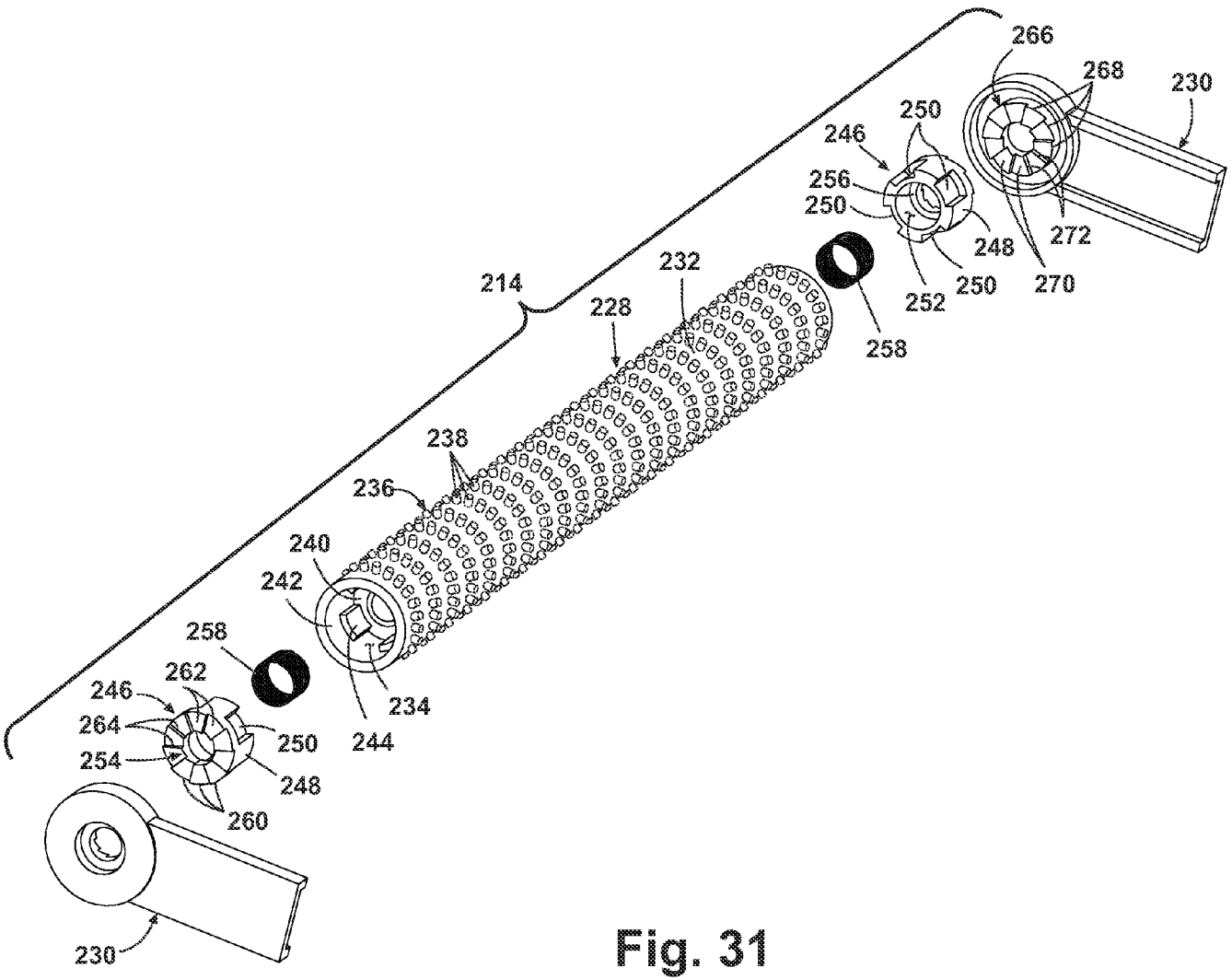
FIG. 31 is an exploded view of the hair collection assembly from FIG. 30.

Referring to FIG. 31, the hair collection assembly 214 comprises a roller 228 supported between a pair of spaced ratchet arms 230 mounted on either side of the agitator chamber 220 so that the roller 228 is positioned forwardly of the suction nozzle 226 and so that the roller 228 is rotatable with respect to the ratchet arms 230. The roller 228 comprises a cylindrical roller body 232 having open ends 234 and a hair collection element 236 in the form of multiple projections 238 extending from the roller body 232. The projections 238 can be made of a material, such as an elastomeric material, that will grip hair and/or other small debris as the hair collection assembly 214 is moved over a surface to be cleaned F. Each open end 234 comprises a spring engagement wall 240 joined with a cylindrical side wall 242 having multiple spaced protrusions 244 formed thereon.

A ratchet slide 246 is positioned within each open end 234 of the roller body 232. Each ratchet slide 246 comprises a generally cylindrical body 248 having a plurality of indentations 250 that engage the protrusions 244 when the ratchet slide 246 is positioned in the open end 234, such that the ratchet slide 246 and the roller 228 are rotationally fixed to one another. However, there is some clearance between the cylindrical body 248 and the side wall 242 that allows the ratchet slide 246 to move axially with respect to the roller 228. The cylindrical body 248 further includes a spring cavity 252 formed on one end and a toothed surface 254 formed on the opposite end. Each spring cavity 254 includes a spring engagement wall 256 and receives a spring 258 that is positioned between the spring engagement wall 256 and the spring engagement wall 240 of the roller 228 to bias the ratchet slide 246 against the ratchet arm 230. The toothed surface 254 comprises a plurality of teeth 260 arranged in a circle. Each tooth 260 comprises a ramp 262 joined by a wall 264 at the upper edge of the ramp 262. The wall 264 of one tooth 260 joins with the lower edge of the ramp 262 of an adjacent tooth 260.

Each ratchet arm 230 comprises a toothed surface 266 that engages the toothed surface 256 of the ratchet slide 246. The toothed surface 266 comprises a plurality of teeth 268 arranged in a circle. Each tooth 268 comprises a ramp 270 joined by a wall 272 at the upper edge of the ramp 270. The wall 272 of one tooth 268 joins with the lower edge of the ramp 270 of an adjacent tooth 268. The toothed surfaces 254, 266 of the ratchet slide 246 and the ratchet arm 230 engage each other in opposing fashion, so that the respective ramps 262, 270 and walls 264, 272 lie against one another.

Figure 32:
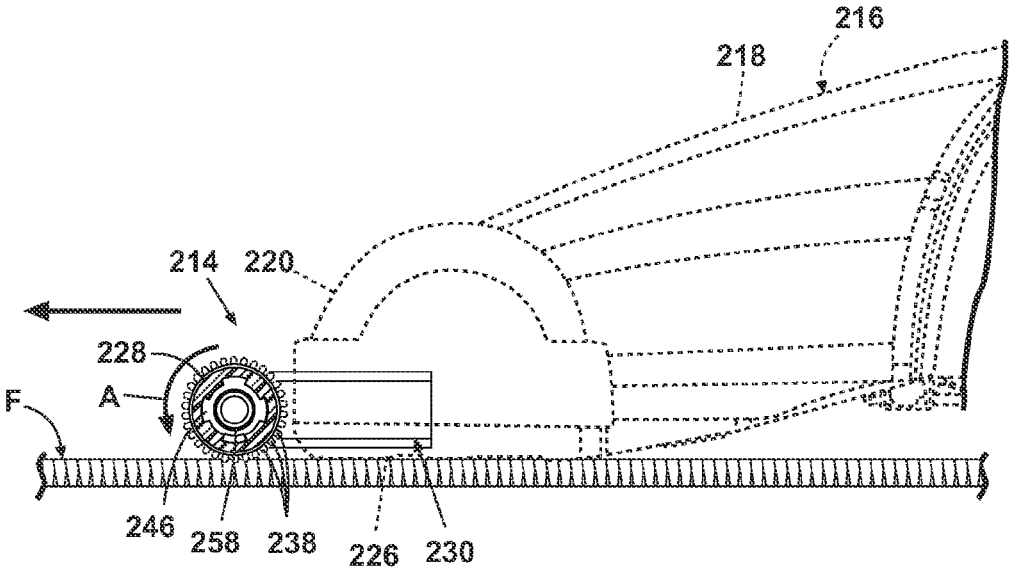
FIG. 32 is a side view of the base assembly from FIG. 30, where the base assembly is moving in a forward direction across a surface to be cleaned.
Figure 33:
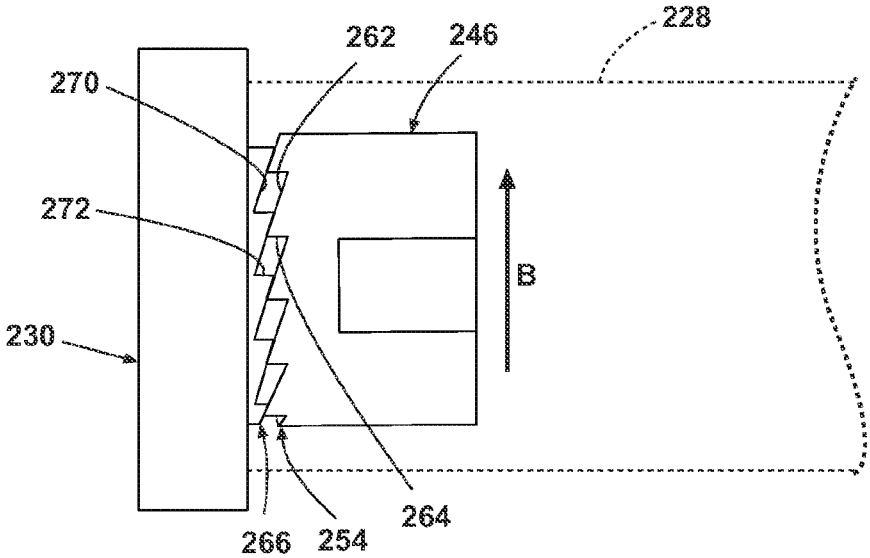
FIG. 33 is a top view of the hair collection assembly from FIG. 30, illustrating the movement of the hair collection assembly when the base assembly is moving in a forward direction across a surface to be cleaned.
Figure 34:
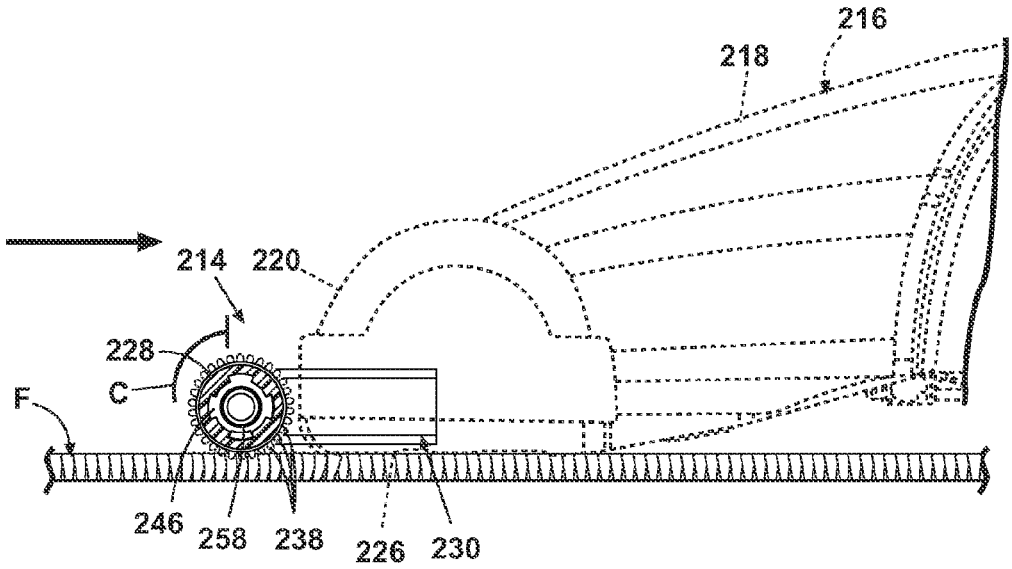
FIG. 34 is a side view similar to FIG. 32, where the base assembly is moving in a rearward direction across a surface to be cleaned.
Figure 35:
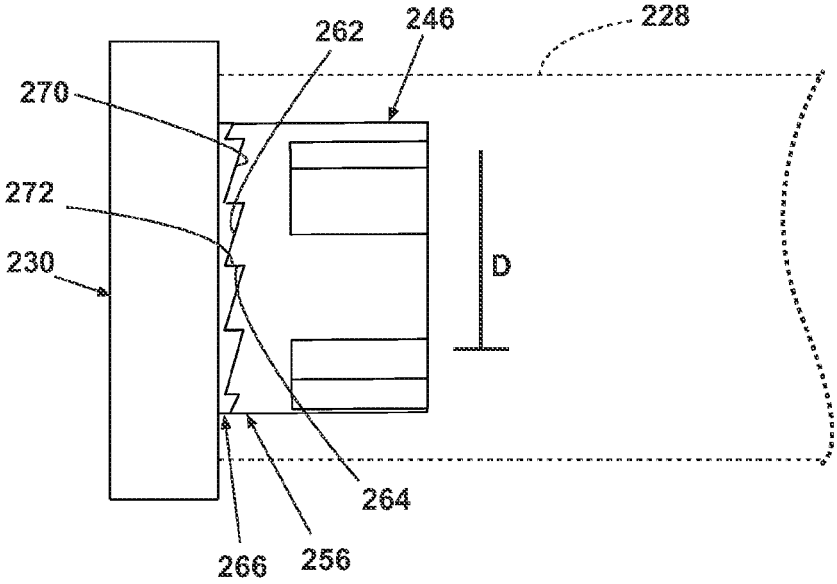
FIG. 35 is a top view of the hair collection assembly from FIG. 30, illustrating the movement of the hair collection assembly when the base assembly is moving in a rearward direction across a surface to be cleaned.
Figure 36:
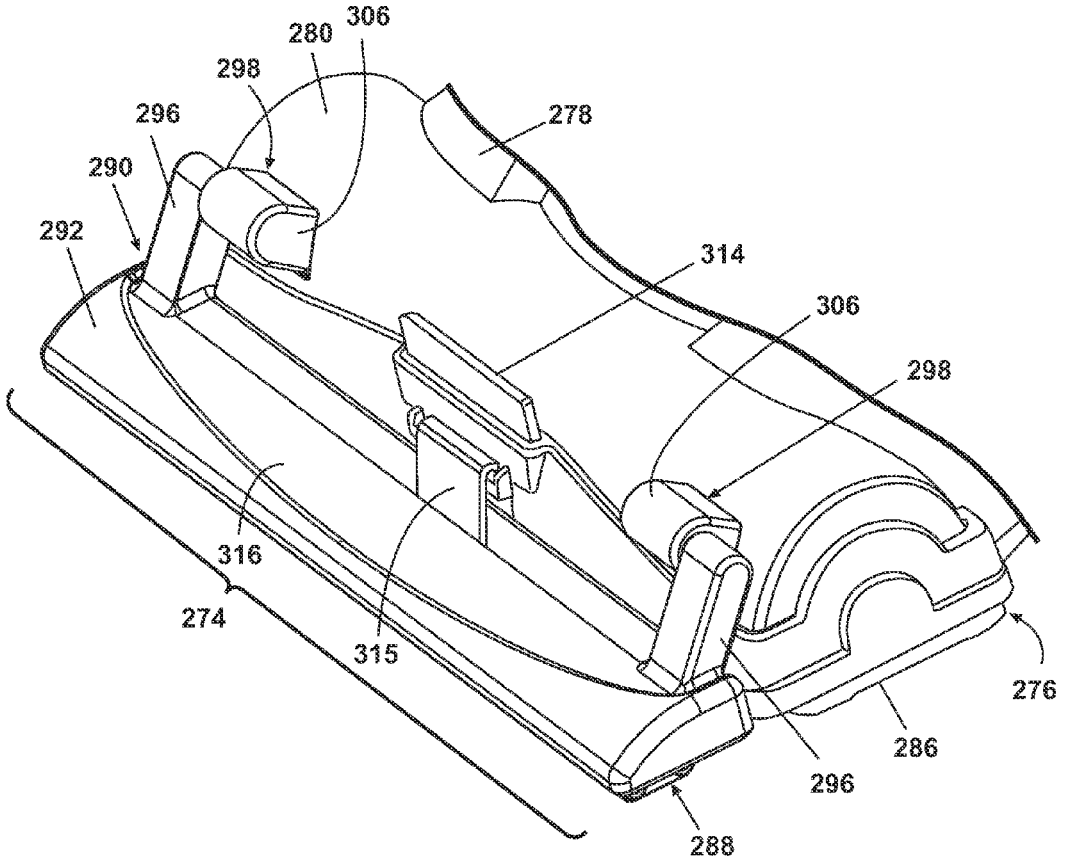
FIG. 36 is a perspective view of a vacuum cleaner base assembly comprising a hair collection assembly in accordance with a tenth embodiment of the invention.
Figure 37:
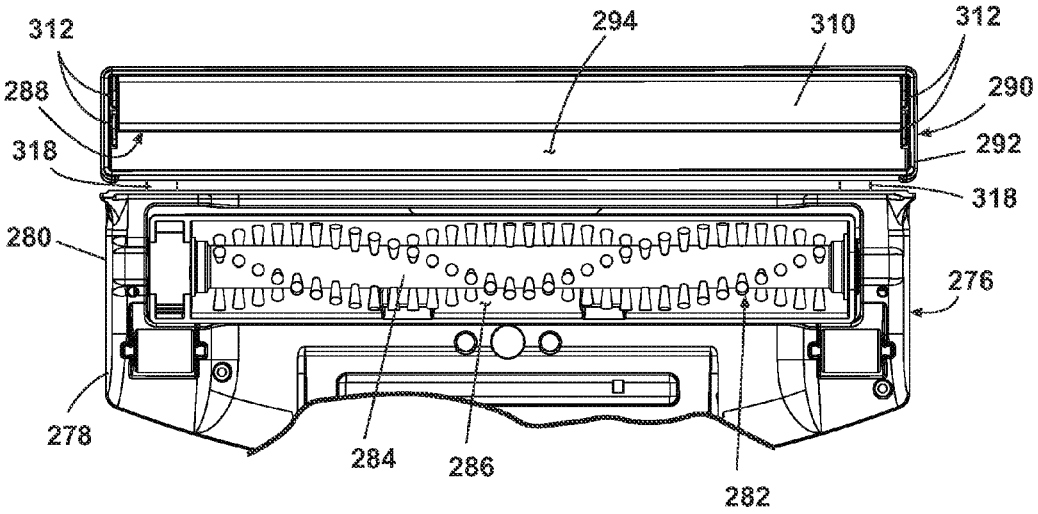
FIG. 37 is a bottom view of the base assembly from FIG. 36.
Figure 38:
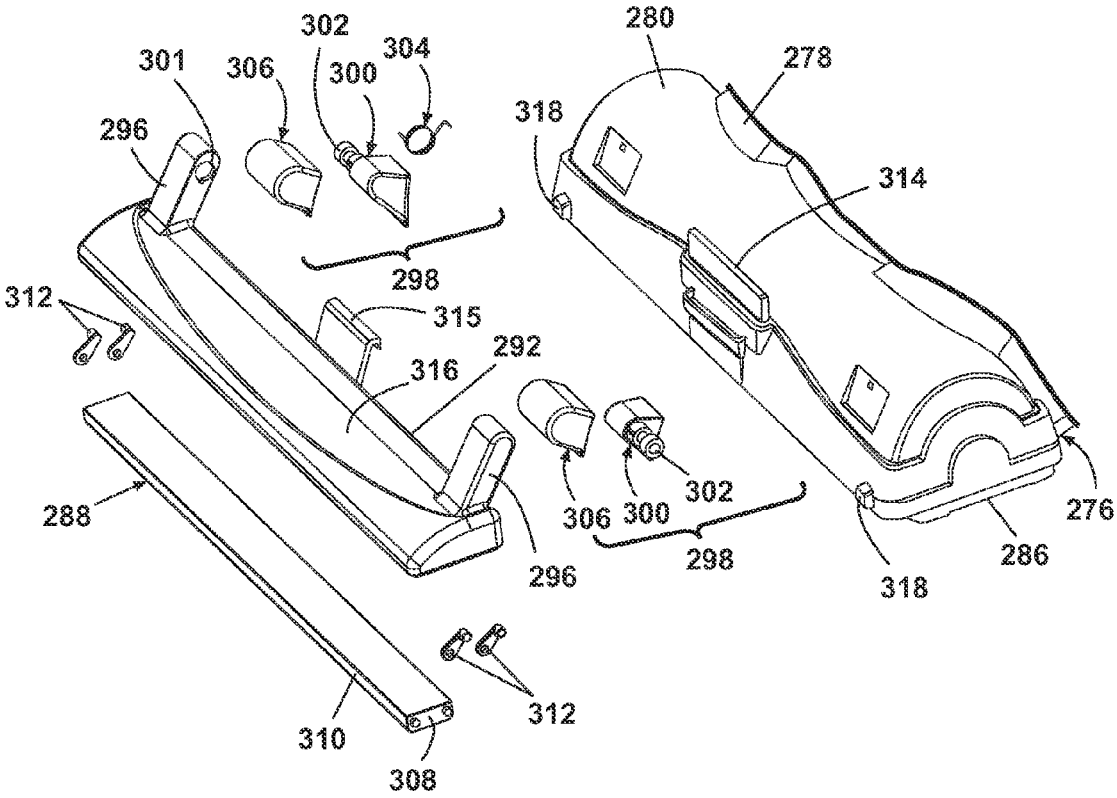
FIG. 38 is a view similar to FIG. 36, showing the hair collection assembly exploded from the base assembly.

In operation, the roller 228 is configured to rotate freely as the base assembly 216 is moved in a forward direction, as shown in FIGS. 32 and 33, and to lock against rotation as the base assembly 216 is moved in a rearward direction, as shown in FIGS. 34 and 35. On each forward stroke of the base assembly 216, friction between the roller 228 and the surface to be cleaned F causes the roller 228 to rotate in a counterclockwise direction with respect to the orientation of FIG. 32, as indicated by arrow A. This is also shown in FIG. 33, where arrow B indicates that the roller 228 rotates in an upward direction with respect to the orientation of the drawing. During rotation, the ramps 262 on the toothed surface 254 of the ratchet slides 246 ride up the ramps 270 on the toothed surface 266 of the ratchet arms 230. Upon reaching the end of one ramp 270, the ramps 262 drop down to engage an adjacent ramp 270 under the biasing force of the springs 258. As the base assembly 216 is moved forwardly with the roller 228 freely rotating, little to no hair and/or other small debris is collected by the hair collection element 236.

On each rearward stroke of the base assembly 216, friction between the roller 228 and the surface to be cleaned F causes the roller 228 to rotate in a clockwise direction with respect to the orientation of FIG. 34, as indicated by arrow C, until rotation is arrested by engagement of the respective toothed surfaces 254, 266 of the ratchet slide 246 and the ratchet arm 230. This is also shown in FIG. 35, where arrow D indicates that the roller 228 rotates in a downward direction with respect to the orientation of the drawing, until opposing walls 264, 272 of the toothed surfaces 254, 266 contact one another and prevent further rotation of the roller 228 with respect to the ratchet arms 230. As the base assembly 216 is moved rearwardly with the roller 228 locked against rotation, the projections 238 will dig against the surface to be cleaned F and collect hair and/or other small debris. At the end of the rearward stroke, a pile of collected hair and debris accumulates, which can then be picked up through the suction nozzle 226 on a forward stroke of the base assembly 216.

Referring to FIGS. 36-41, a tenth embodiment of the invention is shown, where a hair collection assembly 274 is provided on a vacuum cleaner base assembly 276 of a typical upright vacuum cleaner, although the invention is equally effective on canister or stick type vacuum cleaners also. The base assembly 276 comprises a housing 278 having an agitator chamber 280 formed at a forward portion thereof, which houses a commonly known agitator assembly 282 in the form of a rotatable brushroll 284 for agitating the surface to be cleaned, however it can be appreciated that the invention can be practiced with or without an agitator assembly 282. A suction nozzle 286 is formed at a lower portion of the agitator chamber 280 and is in fluid communication with a remote suction source, as is commonly found in an upright vacuum cleaner.

The hair collection assembly 274 comprises a hair collection element 288 and a mounting assembly 290 for attaching the hair collection element 288 to the base assembly 276. The mounting assembly 290 comprises an elongated casing 292 having a cavity 294 configured to receive the hair collection element 288. A pair of spaced arms 296 are formed on an upper surface of the casing 292, and are pivotally attached to the agitator chamber 280 of the base assembly 276 by attachment assemblies 298. Each attachment assembly 298 comprises a hinge 300 mounted to the agitator chamber 280 and having a pivot shaft 302 rotatably connected to a shaft receiving hole 310 in each of the arms 296. A torsion spring 304 is held between the one of the hinges 300 and the corresponding arm 296 to bias the arm 296 and the entire hair collection assembly 274 in an upward direction. A latch 314 is provided on the front of the agitator chamber 280 for engaging a hook 315 on the casing 292 to maintain the hair collection assembly 274 in a use position, shown in FIG. 40 and explained below. A compression spring (not shown) biases the latch 314 upward towards the hook 315. The latch 314 can be released from engagement with the hook 315 by pressing vertically downwardly on an upper surface of the latch 314, whereby the torsion spring 304 is free to move the hair collection assembly 274 upwardly to a non-use position, shown in FIG. 39 and also explained below. A cap 306 covers each hinge 300.

The hair collection element 288 comprises an elongated support 308 at least partially covered with a hair collecting material 310. The support 308 is mounted within the cavity 294 by two spaced link arms 312 coupling each end of the support 308 to the casing 292. The linkage arrangement between the hair collection element 288 and the casing 292 positions the hair collection element 288 parallel to the surface to be cleaned F, thereby providing maximum surface contact between the hair collecting material 310 and the surface to be cleaned F and greater hair removal performance. The hair collection element 288 can float over the surface to be cleaned F due to its own weight, thus automatically adjusting to different carpet pile heights without any intervention by the user.

The hair collecting material 310 is preferably a commercially available lint removal material, often referred to as a directional fabric, typically found on commercially available lint brushes. Like a lint brush, the hair collection element 288 will collect hair and/or other small debris when the hair collecting material 310 is drawn across a fabric surface in a first direction. When the hair collecting material 310 is drawn across a fabric surface in the opposite direction, hair and/or other small debris is not collected and, furthermore, any hair and/or other small debris present on the hair collecting material 310 is released onto the fabric surface in a convenient pile. Accordingly, the hair collecting material 310 is attached to the support 308 so that the hair collection element 288 can collect hair and/or other small debris when the base assembly 276 is moved in a rearward direction across the surface to be cleaned F and will not collect hair and/or other small debris when the base assembly 276 is moved in a forward direction across the surface to be cleaned F. Furthermore, the hair collecting material 310 will release and hair and/or other small debris thereon when moving in the forward direction, which can then be easily picked up through the suction nozzle 286.

Figure 39:
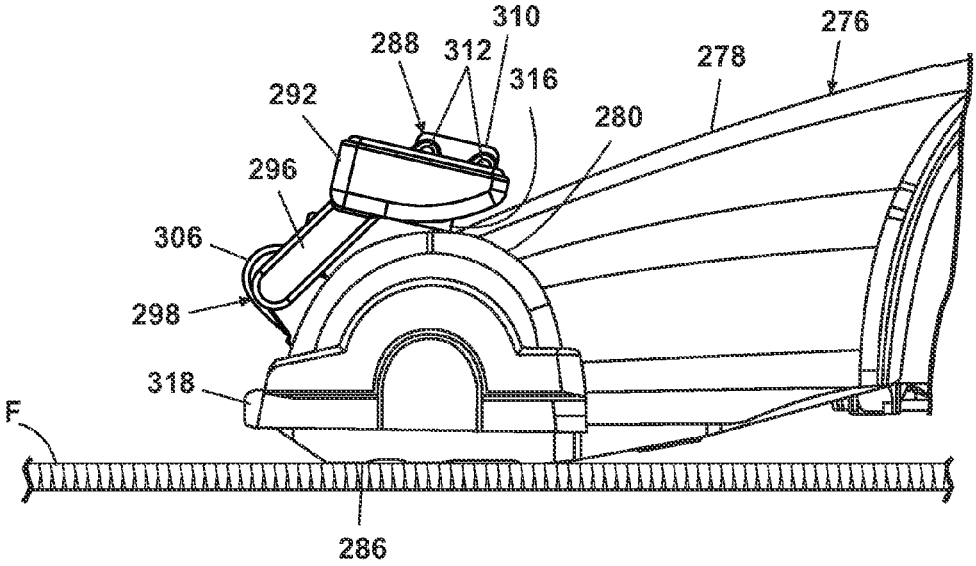
FIG. 39 is a side view of the base assembly, where the hair collection assembly is in a non-use position.
Figure 40:
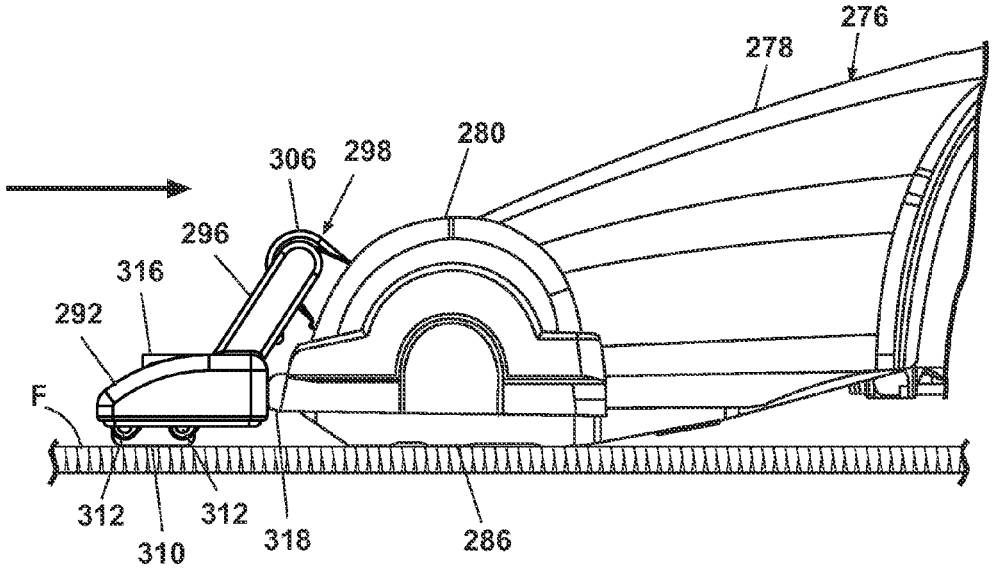
FIG. 40 is a side view of the base assembly, where the hair collection assembly is in a use position and the base assembly is moving in a rearward direction across a surface to be cleaned.
Figure 41:
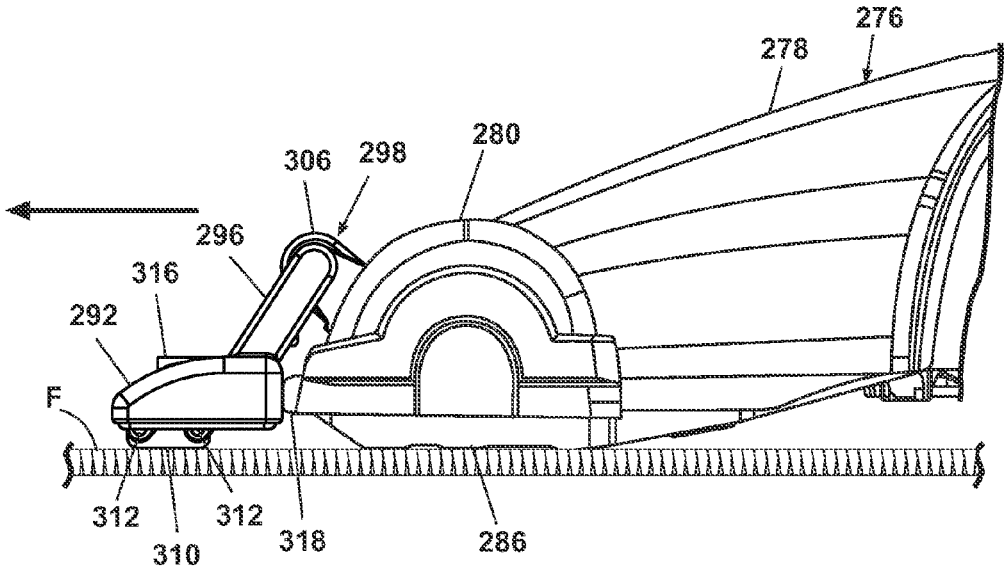
FIG. 41 is a side view similar to FIG. 40, where the base assembly is moving in a forward direction across a surface to be cleaned.
Figure 42:
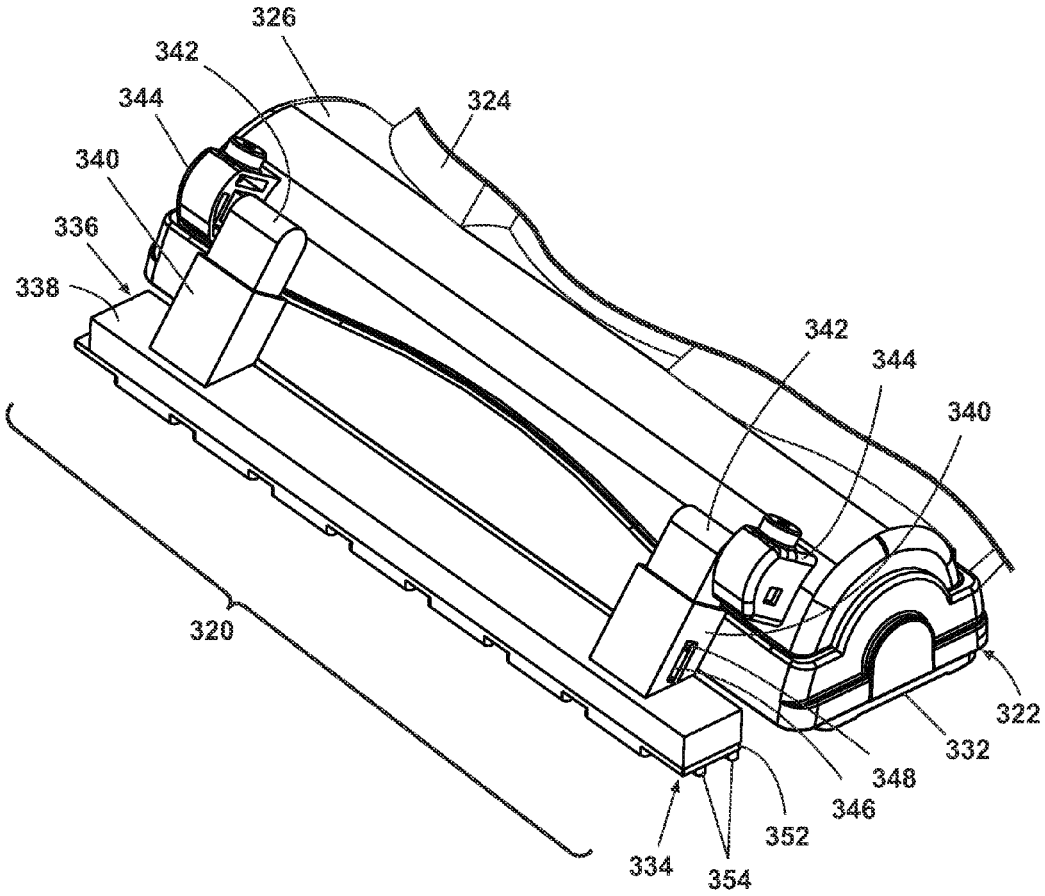
FIG. 42 is a perspective view of a vacuum cleaner base assembly comprising a hair collection assembly in accordance with an eleventh embodiment of the invention.
Figure 43:
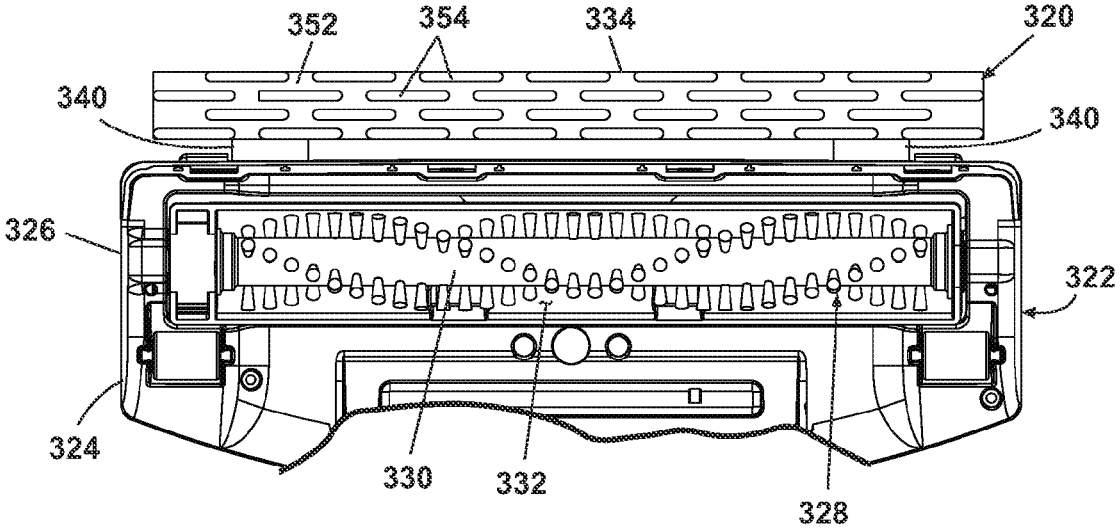
FIG. 43 is a bottom view of the base assembly from FIG. 42.
Figure 44:
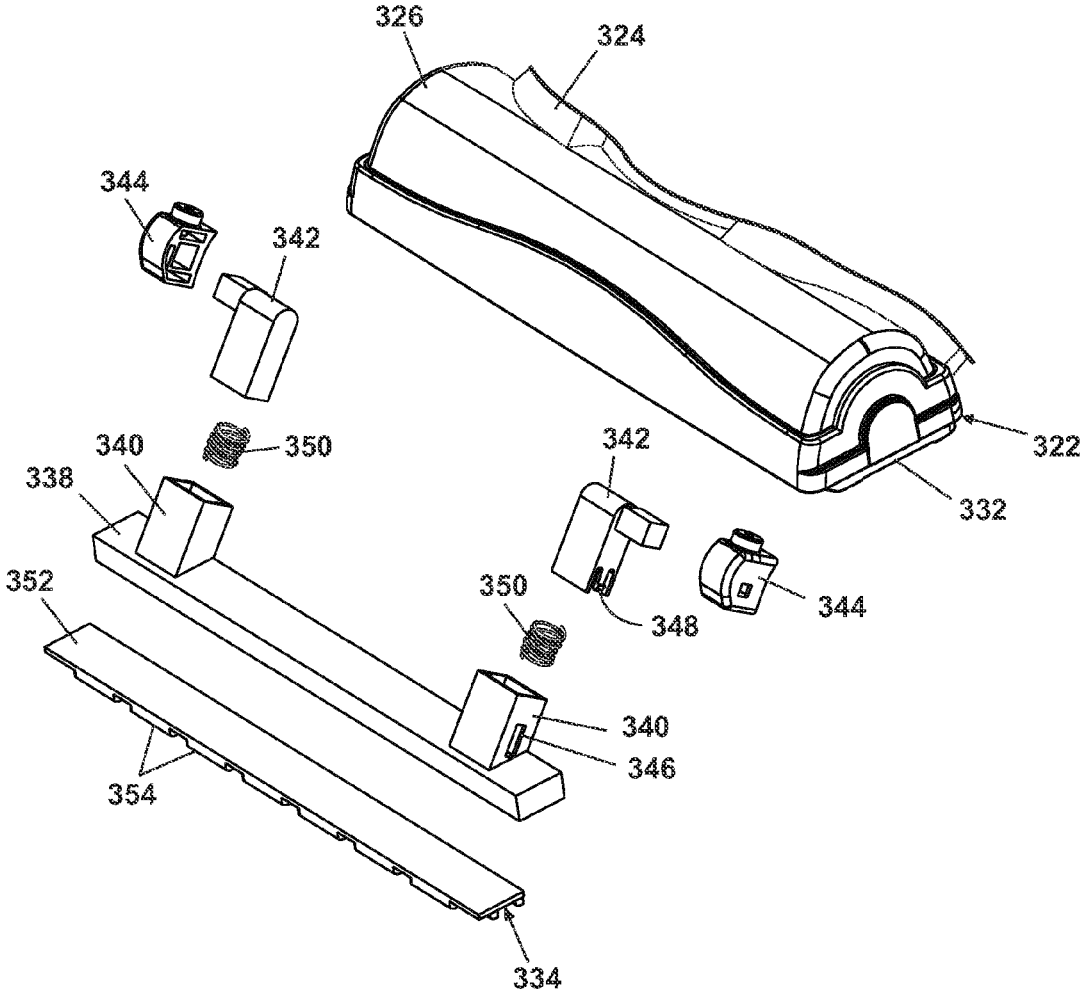
FIG. 44 is a view similar to FIG. 42, showing the hair collection assembly exploded from the base assembly.

Referring to FIGS. 39-41, the hair collection assembly 274 is manually movable between a non-use position, shown in FIG. 39, in which the hair collection element 288 is spaced from the surface to be cleaned F, and a use position, shown in FIGS. 40-41, in which the hair collection element 288 is in contact with the surface to be cleaned F. In the use position, the hair collection element 288 is positioned forwardly of the suction nozzle 286. To move from the use position to the non-use position, the latch 314 is pressed downward to release it from engagement with the hook 315, whereby the hair collection assembly 274 moves to the non-use position under the biasing force of the torsion spring 304. The arms 296 are rotated about the hinges 300 until the casing 292 and/or the arms 296 rest against an upper surface of the base assembly housing 278. Preferably, the casing 292 rests against an upper surface of the agitator chamber 280. A first stop 316 is provided on the casing 292, to provide a secure location for the casing 292 to come to rest against the agitator chamber 280 in the non-use position. Two spaced second stops 318 are provided on the front surface of the agitator chamber 280 against which the casing 292 will rest in the use position. The stops 316, 318 prevent damage to the hair collection assembly 274 or the base assembly 276 when moving between the use and non-use positions.

In operation, to collect hair and/or other small debris, the vacuum cleaner base assembly 276 is moved forward and rearward in a reciprocating fashion over the surface to be cleaned using a common handle assembly that can be pivotally attached to the base assembly 276 with the hair collection assembly 274 in the use position. In the use position as the base assembly 276 is moved in a rearward direction the hair collection element 288 collects hair and/or other small debris on the hair collecting material 310. As the base assembly 276 is moved in a forward direction, the hair collecting material 310 will release and hair and/or other small debris thereon, which is then picked up through the suction nozzle 286.

Referring to FIGS. 42-46, an eleventh embodiment of the invention is shown, where a hair collection assembly 320 is provided on a vacuum cleaner base assembly 322 of a typical upright vacuum cleaner, although the invention is equally effective on canister or stick type vacuum cleaners also. The base assembly 322 comprises a housing 324 having an agitator chamber 326 formed at a forward portion thereof, which houses a commonly known agitator assembly 328 in the form of a rotatable brushroll 330 for agitating the surface to be cleaned, however it can be appreciated that the invention can be practiced with or without an agitator assembly 328. A suction nozzle 332 is formed at a lower portion of the agitator chamber 328 and is in fluid communication with a remote suction source, as is commonly found in an upright vacuum cleaner.

The hair collection assembly 320 comprises a hair collection element 334 and a mounting assembly 336 for attaching the hair collection element 334 to the base assembly 322. The mounting assembly 336 comprises an elongated support 338 having a pair of space outer tubes 340 formed thereon. The outer tubes 340 sliding receive corresponding inner tubes 342 mounted to the agitator chamber 326 by mounting fixtures 344. Each outer tube 340 comprises a slot 346 in which a detent 348 on the inner tube 342 is received. A compression spring 350 is positioned between the outer and inner tubes 340, 342 and biases the tubes 340, 342 apart. This arrangement allows the hair collection assembly 320 to adjust to the height and contour of the surface to be cleaned F, thereby maintaining contact with surface and improving hair collection performance.

The hair collection element 334 is attached to or otherwise supported on the support 338 and extends substantially across the width of the front portion of the base assembly 322. The hair collection element 334 comprises an elongated support 352 and a plurality of spaced projections 354 depending therefrom. As illustrated, the hair collection element 334 is similar to the bottom portion 20 of the first embodiment. The projections 354 are arranged in a plurality of parallel rows extending across the support 352. The projections 354 in each row are aligned and are axially spaced from each other. Adjacent rows of projections 354 are offset from each other, whereby axial spaces between adjacent projections 354 in one row are offset to projections 354 in an adjacent row. Preferably, the projections 354 are made of an elastomeric material. More preferably, both the projections 354 and the support 352 are formed of an elastomeric material. The hair collection element 334 can alternately comprise a different type of hair collector that shown and described for the first embodiment.

Figure 45:
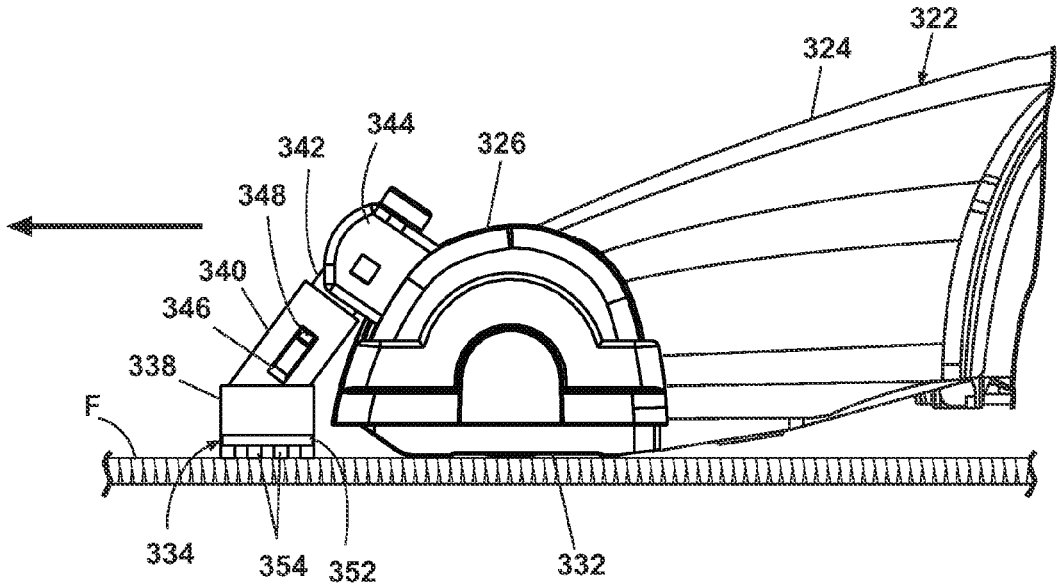
FIG. 45 is a side view of the base assembly, where the hair collection assembly is in a use position and the base assembly is moving in a rearward direction across a surface to be cleaned.
Figure 46:
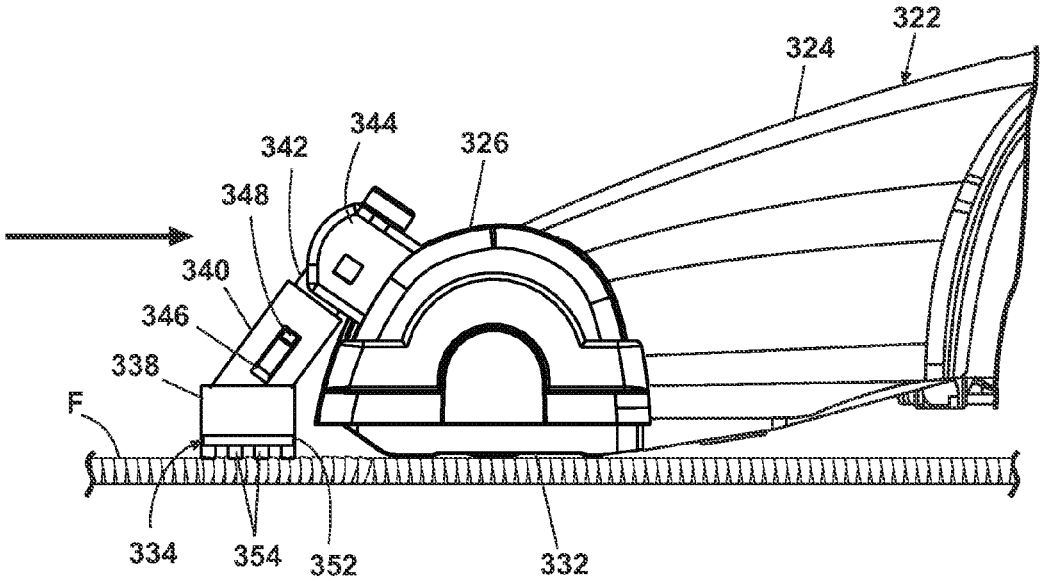
FIG. 46 is a side view similar to FIG. 45, where the base assembly is moving in a forward direction across a surface to be cleaned.

In operation, to collect hair and/or other small debris, the vacuum cleaner base assembly 322 is moved forward and rearward in a reciprocating fashion over the surface to be cleaned using a common handle assembly that is pivotally attached to the base assembly 322. The hair collection element 334 digs against the surface to be cleaned as the base assembly 322 moves, thereby collecting hair and/or other small debris. At the end of each forward and rearward stroke, a pile of collected hair and/or debris accumulates, which can then be picked up through the suction nozzle 332. The hair collection assembly 320 can further be configured to glide or skim over the surface to be cleaned F as the base assembly 322 is moved in a forward direction, as shown in FIG. 45, and to press or dig against the surface to be cleaned F as the base assembly 322 is moved in a rearward direction, as shown in FIG. 46.

While the invention has been specifically described in connection with certain specific embodiments thereof, it is to be understood that this is by way of illustration and not of limitation. For example, while illustrated on an upright vacuum cleaner, it is understood that any of the hair collection assemblies disclosed herein can be provided on the cleaning head of a canister vacuum cleaner, as well as other surface cleaning apparatus. Furthermore, any of the hair collection assemblies and elements can be interchanged to form different combinations and configurations not illustrated herein. Any of the hair collection elements discussed herein can be used on any of the described embodiments. Reasonable variation and modification are possible within the scope of the foregoing description and drawings without departing from the spirit of the invention which is defined in the appended claims.

What is claimed is:

1. A vacuum cleaner comprising:

a cleaning head having a suction nozzle adapted to be moved along and in contact with a surface to be cleaned in a first direction and a second direction opposite the first direction;

a hair collection assembly provided on the cleaning head and comprising an elongated, cylindrical hair collection element which is stationary relative to the cleaning head and adapted to collect hair from the surface to be cleaned as the cleaning head moves along the surface to be cleaned; and a cover flange on the cleaning head extending beneath and partially covering the hair collection element to substantially preclude the hair collection element from collecting hair on the surface to be cleaned when the suction nozzle is moved along and in contact with the surface to be cleaned in the first direction and to allow the hair collection element to collect hair when the suction nozzle is moved along and in contact with the surface to be cleaned in the second direction.

2. The vacuum cleaner from claim 1, wherein the cleaning head further comprises an agitator chamber in fluid communication with the suction nozzle and an agitator provided in the agitator chamber, wherein the hair collection assembly is separate from the agitator.

3. The vacuum cleaner from claim 1, wherein the hair collection element is formed of one of polyurethane and rubber.

4. The vacuum cleaner from claim 1, wherein the cleaning head further comprises a sole plate defining the suction nozzle, and the hair collection element is mounted to the sole plate.

5. The vacuum cleaner from claim 4, wherein the hair collection assembly further comprises a rod having the hair collection element covering at least a portion of the rod.

6. The vacuum cleaner from claim 5, wherein the sole plate includes the cover flange which partially covers a bottom portion of the hair collection element.

7. The vacuum cleaner from claim 5, wherein the rod is indexible between at least two different orientations.

8. The vacuum cleaner from claim 1, wherein the hair collection assembly is positioned within the cleaning head and forwardly of the suction nozzle.

9. The vacuum cleaner from claim 1 wherein the hair collection element is non-rotatably mounted to the cleaning head.

10. The vacuum cleaner from claim 9, wherein the cylindrical hair collection element further comprises an indexible element that is mounted to the cleaning head and indexible between at least two different fixed orientations such that at least two different portions of an exterior surface of the indexible element can be alternatively oriented to rub against the surface to be cleaned.

11. The vacuum cleaner from claim 10, wherein the indexible element comprises rectangular ends and is indexible between four different fixed orientations such four different portions of the exterior surface of the indexible element can be alternatively oriented to rub against the surface to be cleaned.

12. The vacuum cleaner from claim 11, wherein the hair collection assembly further comprises a rod having the hair collection element covering at least a portion of the rod, and wherein the exterior surface of the hair collection element is substantially smooth.

13. The vacuum cleaner from claim 12, wherein a portion of the hair collection element projects through the suction nozzle to contact the surface to be cleaned, and the cover flange forms a front edge of the suction nozzle and extends beneath a front portion of the hair collection element.

14. The vacuum cleaner from claim 13, further comprising an agitator provided in the cleaning head in fluid communication with the suction nozzle, wherein the hair collection element is mounted to the cleaning head forwardly of the agitator.

* * * * *